US006199369B1

(12) United States Patent
Meyer

(10) Patent No.: US 6,199,369 B1
(45) Date of Patent: Mar. 13, 2001

(54) SEPARATE PROCESS ENGINE

(76) Inventor: Daniel J. Meyer, 338 W. Lafayette St., Rushville, IL (US) 62681

( * ) Notice: Subject to any disclaimer, the term of this patent is extended or adjusted under 35 U.S.C. 154(b) by 0 days.

(21) Appl. No.: 09/042,441

(22) Filed: Mar. 13, 1998

Related U.S. Application Data

(60) Provisional application No. 60/036,235, filed on Mar. 14, 1997.

(51) Int. Cl.[7] ..... F02G 3/02
(52) U.S. Cl. ..... 60/39.6
(58) Field of Search ..... 60/39.6, 39.63; 123/222

(56) References Cited

U.S. PATENT DOCUMENTS

| | | | | |
|---|---|---|---|---|
| 891,820 | * | 6/1908 | Cruyt | 60/39.6 |
| 1,076,846 | * | 10/1913 | Slick | 60/39.6 |
| 1,211,950 | * | 1/1917 | Lough . | |
| 1,228,806 | * | 6/1917 | Morris | 123/222 |
| 2,182,430 | * | 12/1939 | Gersman . | |
| 2,373,304 | * | 4/1945 | Garbeth | 123/222 |
| 3,826,086 | * | 7/1974 | Milisavljevic . | |
| 4,106,285 | * | 8/1978 | Hubers | 60/39.63 |
| 4,149,370 | * | 4/1979 | Varges | 60/39.6 |
| 4,696,158 | * | 9/1987 | DeFrancisco . | |
| 4,739,615 | * | 4/1988 | Staheli | 60/39.6 |

FOREIGN PATENT DOCUMENTS

| | | | | |
|---|---|---|---|---|
| 266386 | * | 8/1927 | (GB) | 60/39.6 |

* cited by examiner

*Primary Examiner*—Michael Koczo

(57) ABSTRACT

An external combustion engine burns a mixture of fuel and air to produce work. The engine contains at least one power cylinder, a compression cylinder for each power cylinder, and a moving combustion housing with a plurality of combustion chambers for each power cylinder. Each combustion chamber has a constant volume and cyclically: (1) establishes communication with a compression cylinder to receive compressed air; (2) terminates communication with the compression cylinder; (3) receives sufficient fuel from the fuel injector to create a combustible mixture of fuel and air; (4) contains the ignition of the combustible mixture of fuel and air; (5) establishes communication with a power cylinder to discharge the ignited mixture of fuel and air into the power cylinder; and (6) terminates communication with the power cylinder.

28 Claims, 32 Drawing Sheets

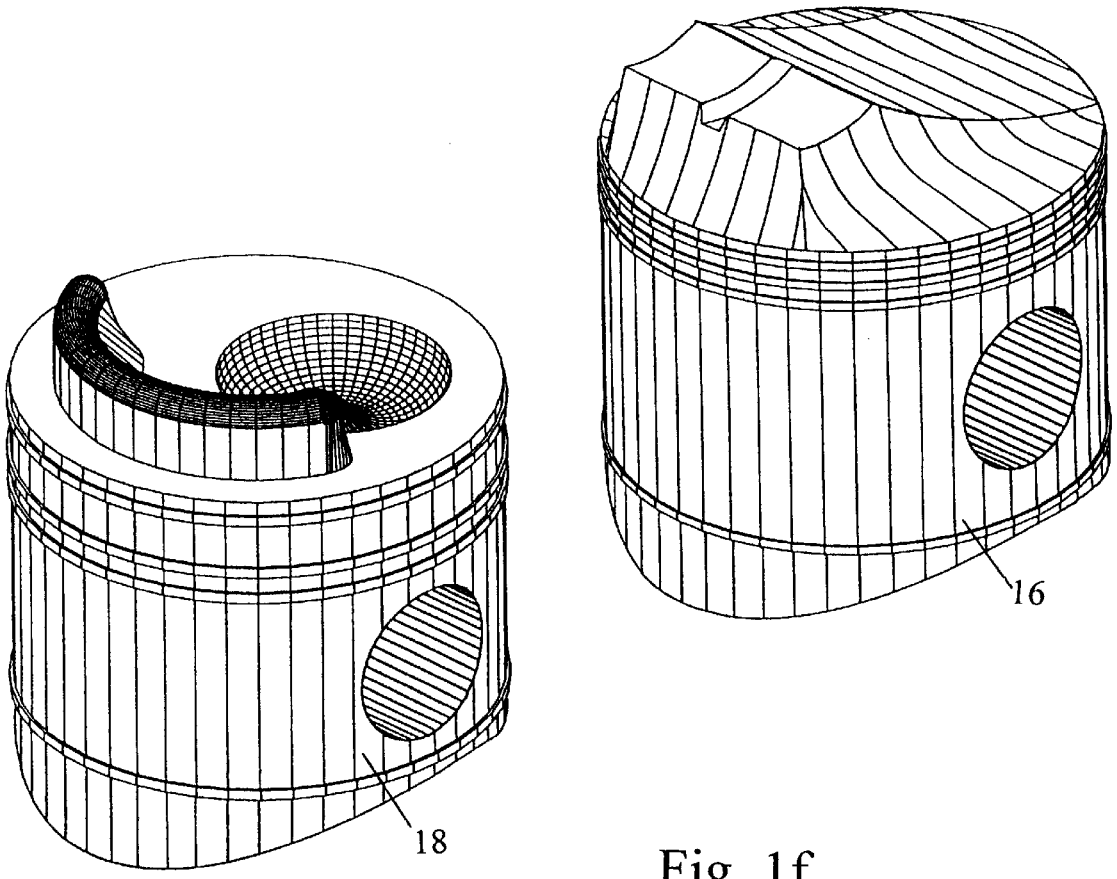
Fig. 1f
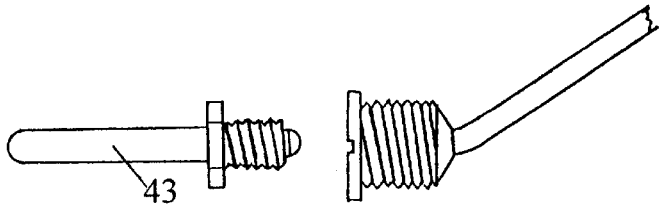

SEPARATE PROCESS ENGINE

CROSS REFERENCE TO RELATED PATENT

This application claims the benefit of U.S. Provisional Application Ser. No. 60/036,235, filed Mar. 14, 1997, now pending.

FIELD OF THE INVENTION

This invention relates to external combustion engines. More particularly, this engine relates to engines which are multi-fueled or can burn many different fuels.

BACKGROUND OF THE INVENTION

There are many positive displacement internal combustion engines which have gained widespread use in the area of locomotion such as automobiles, airplanes, trains, even lawn mowers. These types of engines have allowed mankind to achieve a superior life style compared to the life styles of mankind prior to the internal combustion engine. There are many types of positive displacement internal combustion engines such as two and four stroke gas engines of various configurations and displacements. The diesel engine is another positive displacement internal combustion engine which can also be two or four stroke in operation. The diesel engine is used primarily where high torque and efficiency is desirable and can be manufactured in varying configurations and displacements. The Wankel engine is yet another positive displacement internal combustion engine used where high power output to low weight and engine volume are more important than engine efficiency. There are many such positive displacement internal combustion engines which have been developed throughout the over 100 year history of the internal combustion engine. There is an abundance of books written describing the internal combustion engine such as Internal Combustion Engines by Colin R. Ferguson, 1986, John Wiley & Sons.

There are several problems with the positive displacement internal combustion engines in widespread use today and they will be addressed as follows:

(a) They use the same chamber to induct, compress, combust, expand, and exhaust the working fluid. Since the same chamber is used to carry out all of these operations, the chamber cannot be optimized to do each operation the most efficiently.

(b) The constant volume time for combustion is controlled by the rotational speed of the engine.

(c) A big problem with diesel engines, which have the highest potential for power output due to the ability to allow extreme boosting of intake pressures, is that they suffer from the fact that at higher revolutions per minute of the engine the near constant volume time for combustion is not sufficient to complete combustion when using a fuel injection system.

(d) Engines of present are limited to burning a more select range of fuels such as diesel fuel or gasoline.

These problems could be overcome if the various processes performed in an internal combustion engine could be separated by various gas processors as to best optimize each processor and to allow the burning of a wider range of fuels. When the various processes which are carried out in an internal combustion engine are separated or conducted in separate processors, and in which the combustion is initiated externally of the work producing processor, the engine is classified as an external combustion engine.

Many other inventors have tried to separate the processes of the internal combustion engine and create workable non-steam positive displacement external combustion engines. To date these efforts have failed to gain widespread use.

Lough, U.S. Pat. No. 712,247, issued Jul. 30, 1912, discloses an external combustion engine that uses separate processing chambers where combustion is initiated before transferring its fluid to the work producing processor. The problem with this design is that each chamber used to transfer the working fluid where combustion is initiated has two openings and a long passage used to transfer fluid from the compression processor to the expansion processor. These processing chambers are referred to in the patent as combustion chambers whereby the fluid is transferred. This type of chamber allows for too much surface area which would create excessive heat loss. Also, the frame in which the combustion chambers are an integral part incorporates an inferior sealing of combustion chambers. This tapered frame and tapered frame enclosure would cause excessive friction and insufficient sealing.

Milisavljevic, U.S. Pat. No. 3,826,086, issued Sep. 8, 1971, discloses an external combustion engine that uses separate processing chambers where combustion is initiated. The problem with this design is that each chamber used to transfer the working fluid where combustion is initiated, is stationary with the main block and therefore must incorporate valves. This invention uses poppet valves which are slow in operation. Also, the poppet valves in this invention are used in an unconventional way which requires lifting of the valve stem rather than pushing on it. The way in which the inventor chose to operate the valves would not be durable and would produce unacceptable wear.

Gersman, U.S. Pat. No. 2,182,430, issued May 24, 1935, discloses an external combustion engine that uses separate processing chambers where combustion is initiated before transferring its fluid to the work producing processor. The problem with this design is that each chamber used to transfer the working fluid and where combustion is initiated, is stationary with the main block and therefore must incorporate valves. This invention uses sleeve valves which would cause excessive friction and insufficient sealing.

Defrancisco, U.S. Pat. No. 4,696,158 discloses an external combustion engine that uses separate processing chambers where combustion is initiated before transferring its fluid to the work producing processor. The problem with this design is that long passages are used to transfer the fluid from the compression processor to the processing chamber where combustion is initiated. Also, an accumulator is used. These long passages and accumulator would cause excessive heat loss and unacceptable clearance volumes.

Prior attempts to create non-steam driven positive displacement external combustion engines have failed however, it would be very desirable if a non-steam positive displacement external combustion engine could be manufactured which would separate the processes of an internal combustion engine using separate processors. This would allow the optimization of each processor which would produce higher efficiencies, horsepower, more favorable emissions, and allow the burning of a wider range of fuels.

OBJECTS AND ADVANTAGES

Accordingly, besides the objects and advantages of the Separate Process Engine described in my above patent, several objects and advantages of the present invention are:

Using late injection to control pressures (or simply using diesel injectors) severely limits the compression ignition engine operating range in revolutions per minute. An external combustion engine has been invented in which constant volume time and pressures are controlled by mechanical means, so high revolutions per minute (RPMs) as associated with gas motors are obtainable using diesel fuel or other fuels. This is achieved by isolating the compression, combustion, and expansion processes. This separation of process allows operation with different compression ratios than expansion ratios. This also allows the use of direct injection injectors at high revolutions per minute of the engine as the constant volume time for injection can be controlled by porting and cylinder arrangement around the combustion housing's cylinder head. The Separate Process Engine gas cycle occurs simultaneously within four chambers. The system uses at least four separate processing chambers and is, therefore, named the Separate Process Engine (SPE).

As in larger diesel engines with bores over 500 cc, near constant volume combustion occurs due to long piston duration at or near top dead center (TDC). This occurs as a result of the extremely low revolutions per minute—around 200. The Otto cycle is closely carried out due to the long near constant volume time for injection and combustion. These engines are the most efficient of all piston diesel engines. With the SPE, a near Otto cycle can be carried out at high revolutions per minute. This is achieved by separating the gas process using four separate fluid processors. This new engine and cycle will produce much more power and efficiencies than current state of the art positive displacement internal combustion engines. It will also allow operation on a wider range of fuels.

Separate process optimization is clearly an advantage with the SPE design as the piston compressor, combustion chambers, and piston expander can be optimized to process gas most efficiently. By using at least one compression processor, one expansion processor, and at least two constant volume combustion chamber processors which migrate between the compression processor and the expansion processor, the Otto cycle can nearly be completed with peak pressures being easily set mechanically. This is achieved by varying the compression ratios of the two piston processors, the piston expander and the piston compressor. This allows building motors of lightweight design to run at extreme RPMs or building more sturdy motors to run at moderately high RPMs. Efficiencies should be superior to present positive displacement internal combustion engines due to the lower final state of compression as compared to typical boosted engines and a near Otto cycle being carried out. Peak pressures can be kept down in the piston chambers because there is adequate pressure and heat in the combustion chamber which is transferred to the piston expander to initiate combustion throughout the piston expander. This enables the system to run on diesel fuel even at low piston chamber pressures especially if the glow plug is continually energized. Also, a wider range of fuels can be used as each processor can be optimized to burn a particular fuel. Gasoline can also be processed more efficiently as constant volume combustion can be completed at extreme revolutions per minute of the crank shaft increasing efficiency and horse power.

The ability to produce lower emissions is a key advantage with the SPE as processing chambers can be optimized to produce lower emissions. The ability to operate with different compression than expansion ratios, the ability to mechanically control constant volume time, and the unique transfer of gas from one processor to another allowing a controlled combustion are a few reasons why the SPE will yield improved emissions of burnt fuels. Insulation of combustion chambers and other processors would improve the emissions of some fuels and limit heat loss.

The piston compressor can be made with a larger, smaller, or the same diameter piston as the piston expander. The piston compressor can be made with a larger, smaller, or same stroke length as the piston expander. This allows building motors to accomplish a wide variety of configurations such as burning various fuels more efficiently, emission friendly, and rapidly. This rapid burning will lower heat loss per cycle, increase efficiencies, and boost horsepower due to the high revolutions per minute of the engine. Further objects and advantages of my invention will become apparent from a consideration of the drawings and ensuing description.

BRIEF DESCRIPTION OF THE DRAWINGS

FIG. 1*bb* shows the end of loading the combustion chamber via the piston compressor while the piston expander is compressing its gas.

FIG. 1*bc* shows the piston compressor dropping below atmosphere while the combustion chamber is being injected into. The piston expander has finished compressing its gas and is ready to receive the charge from the combustion chamber.

FIG. 1*cb* shows a possible piston expander port shape.

FIG. 1*cc* shows a possible piston expander port shape.

FIG. 1*f* shows a possible compressor piston, expansion piston, and a glow plug.

FIG. 1*k* shows a partial view of the head of the preferred embodiment.

FIG. 1*l* shows a combustion housing journal bearing.

FIG. 2*bb* shows the end of loading the combustion chamber via the piston compressor while the piston expander is compressing its gas.

FIG. 2*bc* shows the piston compressor dropping below atmosphere while the combustion chamber is being injected into. The piston expander has finished compressing its gas and is ready to receive the charge from the combustion chamber.

1. REFERENCE NUMERALS IN DRAWINGS

Figure 1A:
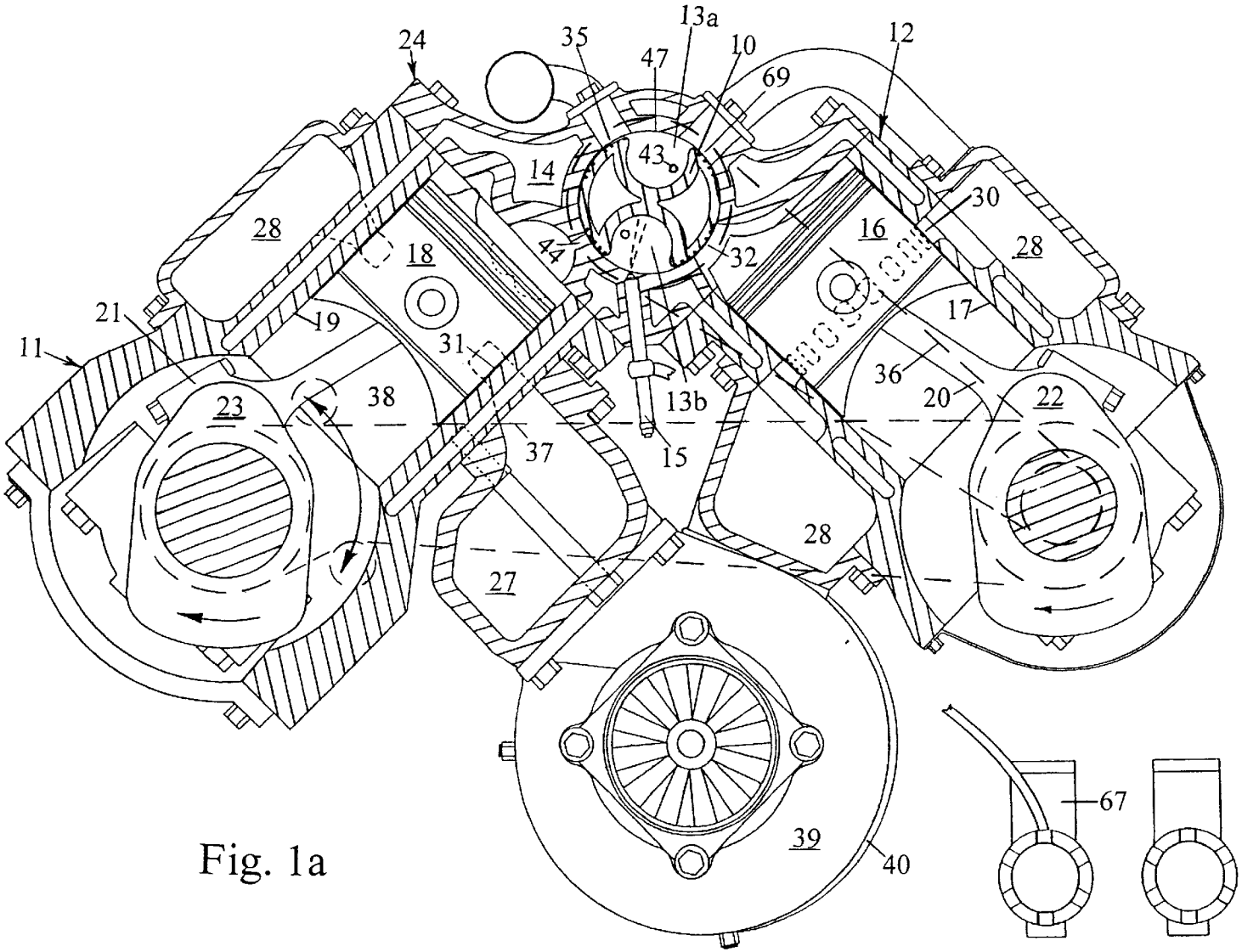
FIG. 1*a* shows a sectional view of one preferred embodiment of the SPE.

| | |
|---|---|
| 10 | Combustion Housing |
| 11 | Piston expander |
| 12 | Piston compressor |
| 13a 13b | Combustion chambers |
| 14 | Water jacket |

-continued

1. REFERENCE NUMERALS IN DRAWINGS

| | |
|---|---|
| 15 | Injector |
| 16 | Compression piston |
| 17 | Compression cylinder |
| 18 | Expansion piston |
| 19 | Expansion cylinder |
| 20 | Compressor piston rod |
| 21 | Expander piston rod |
| 22 | Compression crank |
| 23 | Expansion crank |
| 24 | Head |
| 25a | Cylindrical Rings |
| 25b | flat rings |
| 26 | Ring pins |
| 27 | Exhaust manifold |
| 28 | Intake manifold |
| 29 | Oil pump |
| 30 | Intake port |
| 31 | Exhaust port |
| 32 | Compressor/combustion induction port |
| 33 | Combustion/expander exit port |
| 34 | Combustion exhaust port |
| 35 | Combustion scavenging exhaust port |
| 36 | Combustion housing drive chain or belt |
| 37 | Compressor crank to expander crank drive chain |
| 38 | Compressor crank to expander crank drive advance system |
| 39 | Turbo expander |
| 40 | Turbo compressor |
| 41 | Compound turbo expander |
| 42 | Compound turbo compressor |
| 43 | Glow plug |
| 44 | Restricted throat |
| 45 | Combustion housing advance |
| 46 | Journal bearings |
| 47 | Head cylinder |
| 48 | Commutator |
| 49 | Oil injection ports |
| 50 | Crank case intake ports |
| 51 | Reed valves |
| 52 | Scavenge piston |
| 53 | Scavenge cylinder |
| 54 | Compressed air plenum |
| 55 | Crank case scavenge intake ports |
| 56 | Scavenge intake ports |
| 57 | Combustion housing bearing |
| 58 | Combustion housing water seal |
| 59 | Combustion housing oil seal |
| 60 | Seal pin holes |
| 62 | Combustion housing drive sprocket |
| 63 | Fuel pump cam |
| 64 | Poppet intake valve |
| 65 | Poppet exhaust valve |
| 66 | Flutter valves |
| 67 | Fuel pump |
| 68 | Combustion chamber exhaust port |
| 69 | Combustion scavenging intake port |
| 70 | Scavenge pump |
| 71 | Igniter |
| 72 | Electrical discharge pickup plate |

2. THE PREFERRED EMBODIMENT

Refering to FIG. 1*a*. In the most simple definition, this engine consists of a piston compressor 12 which compresses its air into a combustion chamber 13*a*. The combustion chamber 13*a* is then quickly sealed off from communication with the piston compressor and held at constant volume for a pre-determined time in which it is injected into, with the ability to fuel rich. The constant volume combustion chamber 13*a* then quickly opens to a different piston's chamber, the piston expander 11 near the end of its compression stroke. The high pressure partially combusted fuel and air from the combustion chamber 13*a* moves into the piston expander's chamber and mix with the piston expander's gas. These gases combine, mix, and burn rapidly driving the expansion piston 18 down. The constant volume chambers open and close the communication with the piston chambers by being an integral part of a combustion housing 10 which rotates within a common head 24 shared by the piston compressor and piston expander. The combustion housing houses at least two constant volume chambers 13*a* and 13*b* on opposite sides of the combustion housing.

The system is defined by three separate gas cycles since two of the processing chambers share the same cycle only 360 degrees out of phase of each other. The piston compressor's cycle will be described first. Initially the piston compressor fills with atmospheric air through lower porting 30 similar to a two stroke diesel when the piston is below the intake ports. The intake ports are supplied with fresh air through the intake manifold 28. The air is compressed inside the compression cylinder 17 and head 24 on the upward stroke of the compression piston 16 via the compression piston rod 20 and compression crank 22 and moves into a combustion chamber 13*a* located inside the combustion housing via the compressor/combustion induction port 32. Somewhere after Top dead center (ATDC) of the compression piston, the combustion chamber 13*a* is rapidly separated from the piston compressor's chamber. This separation occurs when the combustion chamber 13*a* rotates beyond the compressor/combustion induction port. The compressor piston travels downward with most of its volume removed and initially re-expands the clearance volume. Almost immediately the pressure in the piston compressor's chamber drops below atmosphere and then slowly drops to a near vacuum. If the pressure in the crank case is lower than the atmosphere, very little work is done to pull the piston down. Intake ports open near the bottom of the stroke in which atmospheric pressure, which can be boosted, rushes in to fill the near vacuum until the ports are again covered. The compressor piston continues upward and compresses into a second combustion chamber 13*b*. The piston compressor completes this same cycle every two piston strokes oscillating between the two combustion chambers 13*a* and 13*b*.

The combustion chambers can be equipped with glow plugs 43 which are initially injected directly on at the beginning of the constant volume injection period. The glow plugs are powered through a commutator 48 as illustrated in FIGS. 1*f* and 1*g*. As the combustion chamber 13*a* migrates towards the piston expander, the heating element moves away from the injection spray which sweeps the chamber for good distribution of fuel. The heating elements need to only be active during initial start up, yet should allow start up with compression ratios which are very low. Unlike divided chambers, the gas is not compressed through a small throat 32; rather, a huge throat is used which closes very rapidly at the end of compression. High compression pressures should not be needed to initiate start up since high amounts of heat are not lost to the throat due to velocity of the gas and to the walls because of swirl, as is typical of divided chambers. The constant volume chamber might be more quiescent and if low pressure single hole injectors are used a larger portion of the burning should take place later in the cycle and in the main expansion chamber, just around the time the expansion piston reaches TDC and shortly after the volumes combine. Since the combustion chambers are of very sturdy construction, high peak pressures can be tolerated in them. As the combustion chamber completes its migration towards the piston expander, its gas rapidly or slowly enters the expansion pistons chamber determined by combustion exit/expander port 33 design.

Figure 7B:
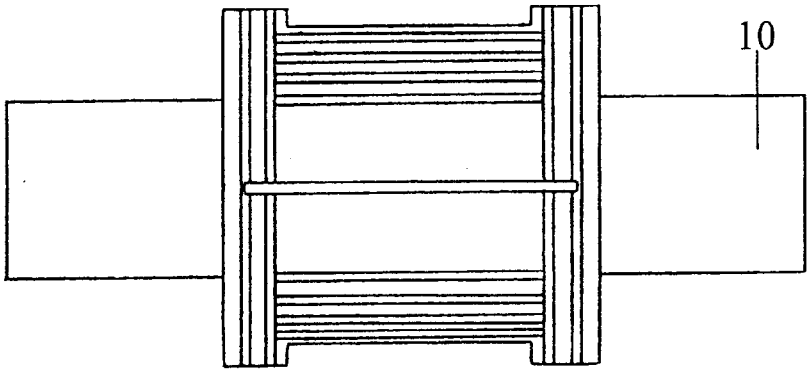
FIG. 7*b* shows a possible single unit combustion housing and ring configuration.

This combining of gases can occur at various expansion piston positions which can be controlled during operation via the compressor crank to expander crank drive advance system 38. The compression crank 22 and the expansion crank 23 are sequenced together using rotational timing using gears, sprockets, belts, a chain or other rotary transmission means. During idle, the combustion chamber could open to the piston expander near or after top dead center. As rotational speeds go up, it could open to the piston expander after remaining at constant volume for the same time yet at varied degrees before top dead center of the expansion piston via the compressor crank to expander crank drive chain advance system. This extends the constant volume time of the cycle. The gas speeds during mixture could be sonic as the gas exits the combustion chamber through the combustion/expander exit port and travels through a restricted throat 44 into the piston expander's main chamber which is composed of the expansion cylinder 19, the expansion piston, and the head. The mixing should occur rapidly and with divided chamber characteristics. The combustion chamber remains in direct communication with the piston expander during expansion and initially can dump to the turbos 39 (if used) or exhaust system while the piston expander's exhaust ports 31 are open. The combustion chamber is now rapidly separated from the piston expander's chamber. The combustion chamber now isolated, can dump to the atmosphere or to a turbo charger through the combustion exhaust port 34 (if used) and is scavenged in the latter portion of dumping to atmosphere by boost pressure contained in the intake manifold which supplies the combustion scavenging ports 35 (if used) before the recombining of the combustion chamber with the piston compressor's chamber. The combustion housing can be driven with a belt or chain 36 or other rotary transmission device. The combustion housing advance system 45 advances and retards the combustion housing's relationship to the piston compressor for improved loading. The combustion housing is suspended inside the head via journal bearings 57 and journal caps 37, or other types of bearings such as needle, roller, ball, or tapered. The combustion housing rotates within the head as it is chained or belted to the compression crank via sprockets 62, pulleys or other rotary transmission means. The combustion housing rotates once for every two revolutions of the crank shafts if a dual volume combustion housing is used. The combustion chambers are sealed by combustion housing seals consisting of cylindrical rings 25*a*, and flat rings 25*b*, which seal the combustion chamber volumes inside the head cylinder 47. The flat rings can be pressed against the head cylinder by springs 61. Rings can be oiled directly on to, using oil ports 49 from an oil pump 29. Oil ports can be placed throughout the head cylinder to supply adequate lubrication. Ring pins 26 are used to contain gas flow within the piston ring crevice volume. The ring pins are placed in seal pin holes 60 which are drilled at the bottom of the ring groove. The cylindrical combustion housing seals can be driven by one of the flat ring seals shown in FIG. 1*j*. The cylindrical rings can be driven by extensions of the rings as illustrated in FIG. 7*c*.

The piston expander's cycle will be described beginning at the bottom of the stroke where loop scavenging takes place. When the exhaust ports are covered on the upward stroke as the expansion crank rotates and pushes the expansion piston up using the expander piston rod 21, the expansion piston begins compressing its gas which is confined by the expansion cylinder and head; part of this gas moves into the piston expander's restricted throat. As the expansion piston approaches TDC, a partially combusted combustion chamber's volume is added to the piston expander's volume through the combustion/expander exit port. The piston expander's pressure rises as the high pressure fuel rich gas enters from the combustion chamber via the combustion/expander exit port; if indeed the piston expander's pressure is lower than the combustion chamber at the time of combining. The final compression pressures in the piston expander can be lower than the combustion chamber at the time of combining. The initial compression pressures in the piston expander can be lower than necessary for autoignition since the high pressure gas being added to the piston expander's gas from the combustion chamber can do the final compression work quickly bringing the piston expander's pressures up to autoignition state. Mixing and burning should take place rapidly. The expansion piston extracts work on the downward stroke then dumps to the exhaust manifold 27 which leads to a turbo expander (if used) when the exhaust ports open. The piston expander is again loop scavenged when its intake ports open and completes this same cycle every two strokes oscillating between the two combustion chambers. The peak piston expansion pressures can be kept down, yet the mean effective pressures can be high due to the less amount of compression work carried out on the gas, the closer to Otto cycle than diesel cycle that it can be carried out, and the fact that the piston expander is supercharged every power stroke with the additional gas and volume.

Figure 3A:
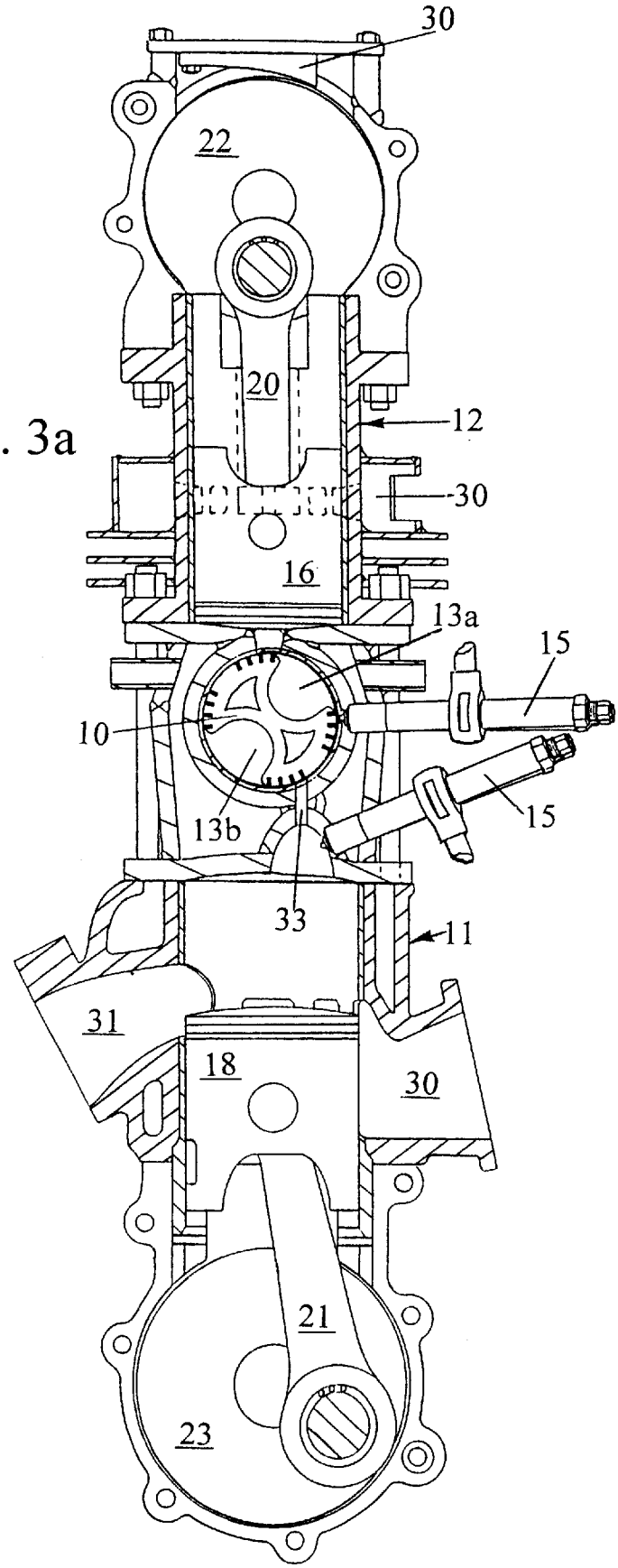
FIG. 3*a* shows a dual crank crankcase scavenged SPE.
Figure 4:
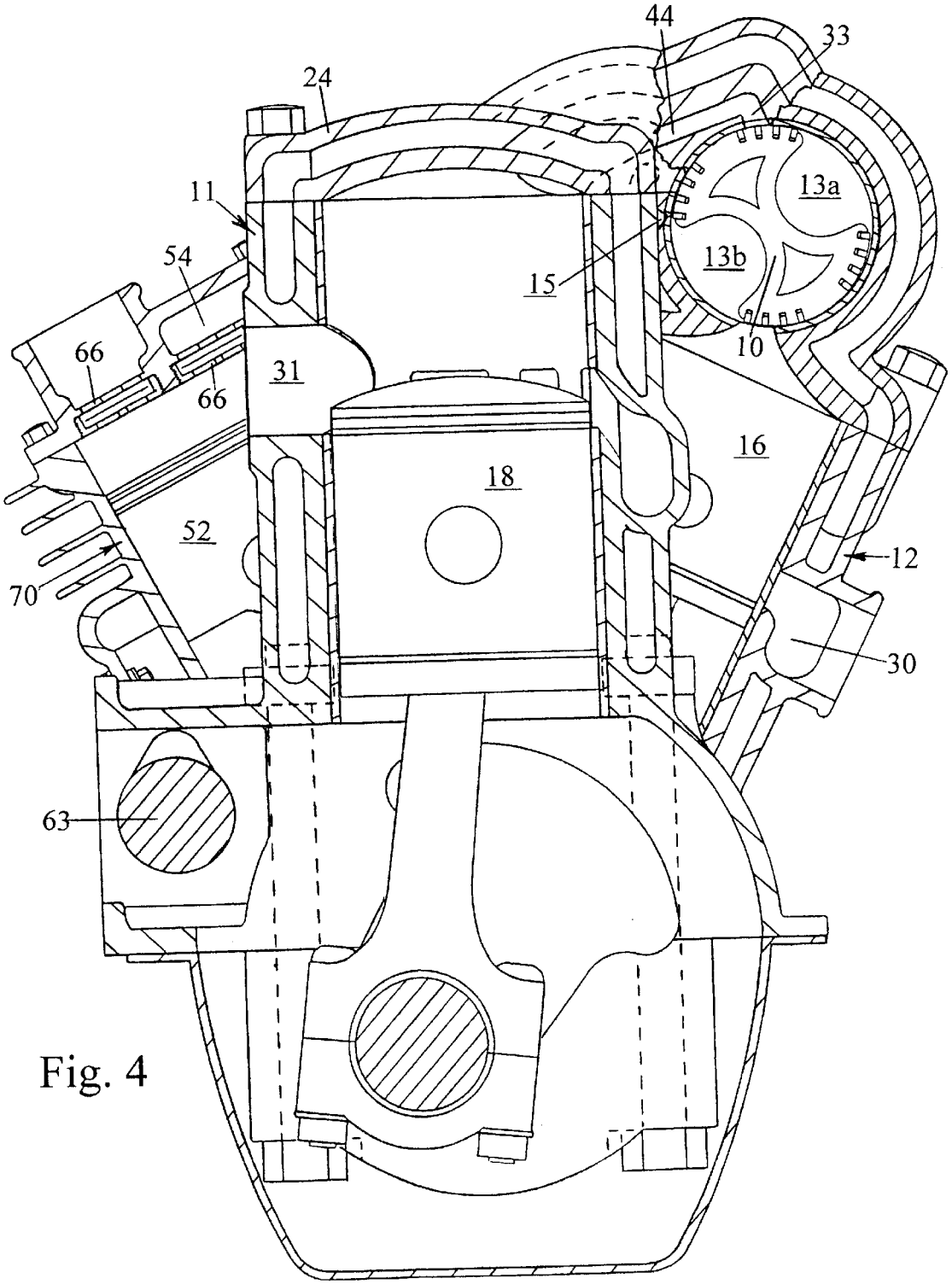
FIG. 4 shows a single crank shaft embodiment which incorporates a scavenge pump.

The injection can be split by placing an injector 15 within the piston expander and injecting into the piston expander in combination with injecting into the combustion chambers as shown in FIG. 3*a* and FIG. 4. This injection can be achieved by using separate injection methods or by joining the injectors in pairs which share the same injection line. The pairs could consist of one combustion chamber injector with one piston expander injector sharing the same injection line. Autoignition can be achieved in the piston expander by using a high enough compression ratio in the piston expander, or when the combustion chamber and piston expander combine using the high pressure and temperature gas from the combustion chamber to induce combustion.

FIG. 1*a* illustrates a cutaway of one SPE unit. One SPE unit consists of a (1) piston compressor which includes a compression piston, compressor piston rod, compression crank, and compression cylinder; (2) piston expander which includes an expansion piston, expander piston rod, expansion crank, and expansion cylinder; (3) two or more combustion chambers located in a moveable combustion housing and mounted in the head; (5) injection system; and (6) manifolds. The SPE will operate as one SPE unit or units that can be hooked together to form a four cylinder double unit, a six cylinder triple unit, an eight cylinder four unit configuration, a ten cylinder five unit configuration, a twelve cylinder six unit configuration, and so on as a seven or eight unit, etc.

The compressor piston is simply a compressor that pumps fresh air every two piston strokes. It can be made of lightweight even composite materials. Its final state of compression will be the highest pressure it will experience because no combustion is carried out in it. It can incorporate a light weight rod and crank.

The combustion housing can be made of various metals such as aluminum, cast iron, or titanium, etc. It could possibly be made of ceramic composite or the combustion chambers can be fitted with ceramic inserts or coated with ceramics to allow higher combustion chamber surfaces for enhanced combustion and to slow heat loss. The inserts could be constructed to leave a space between the insert and the housing to further isolate heat loss from the combustion chamber.

The second piston is the expansion piston. It is of two cycle loop scavenging design as it extracts work every time down or every two piston cycles. It can be over scavenged by exhaust energy through turbochargers 40 if used, which is later described in more detail. This serves to cool the piston, cylinder, and exhaust temperatures. The over-processing of air is carried out quite efficiently since the extra energy input will be nearly recaptured in the exhaust turbines. The fact that the over scavenging fresh air will be of higher pressure with lower temperatures than the exhaust gas it mixes with will allow good turbine performance without overheating of the exhaust turbines. This also allows more fresh air to be introduced to the piston expander which will be burnt every two piston cycles.

Both pistons process fresh air to be burnt every two strokes, yet only the expansion piston extracts combustion energy. The compressor piston is considered as a supercharger to the expansion piston, yet it processes its air to autoignition pressures and temperatures. The compressor piston precedes the expansion piston to TDC by a chosen amount of crank angle rotation. In FIG. 1, this is 80 degrees. If higher RPMs are expected, then the compressor piston can be set in a relationship farther ahead of the expansion piston by extending the space between the compressor/combustion induction port and the combustion/expander exit port. This extends the constant volume time of the cycle and allows longer constant volume injection/combustion time of the gas in the migrating combustion chambers.

Figure 1B:
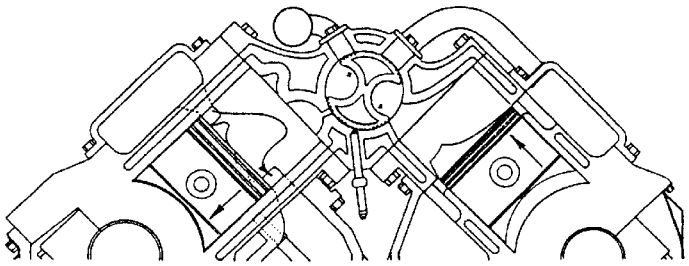
FIG. 1*ba* shows the beginning of loading the combustion chamber via the piston compressor while the piston expander is scavenged.
Figure 1C:
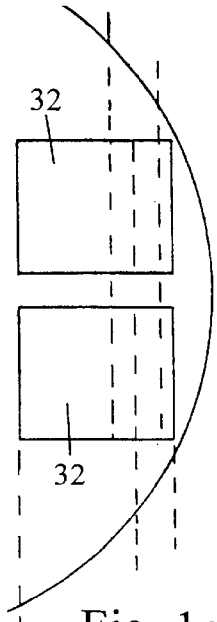
FIG. 1*ca* shows one possible piston compressor port configuration.
Figure 1B:
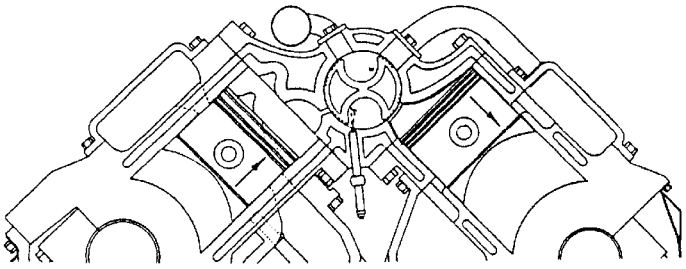
Figure 1B:
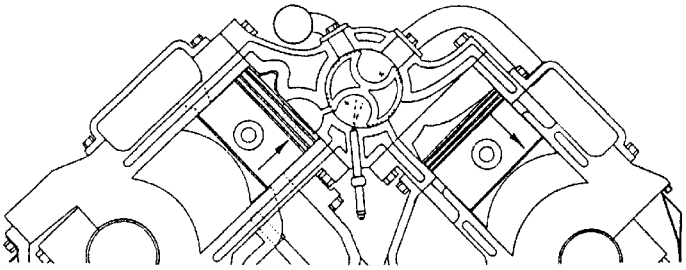
Figure 1C:
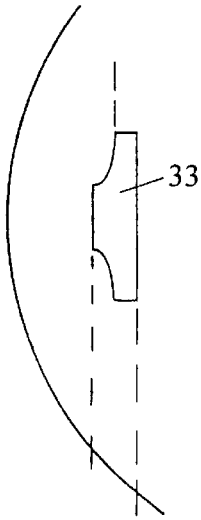
Figure 1C:
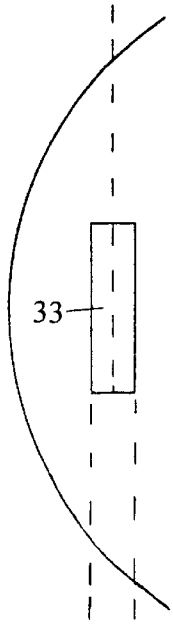
Figure 1D:
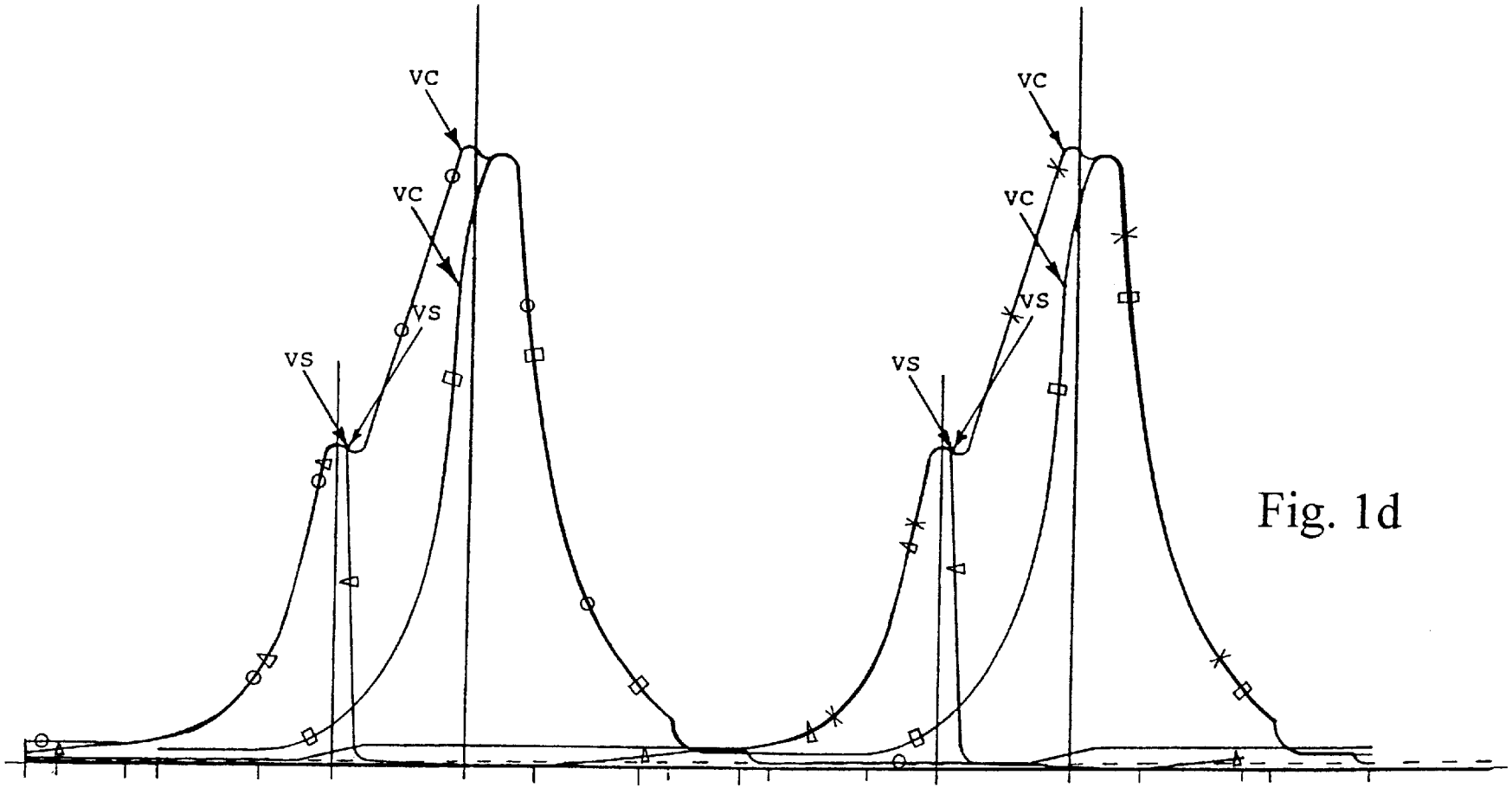
FIG. 1*d* shows a possible pressure trace of the processing chambers.
Figure 1E:
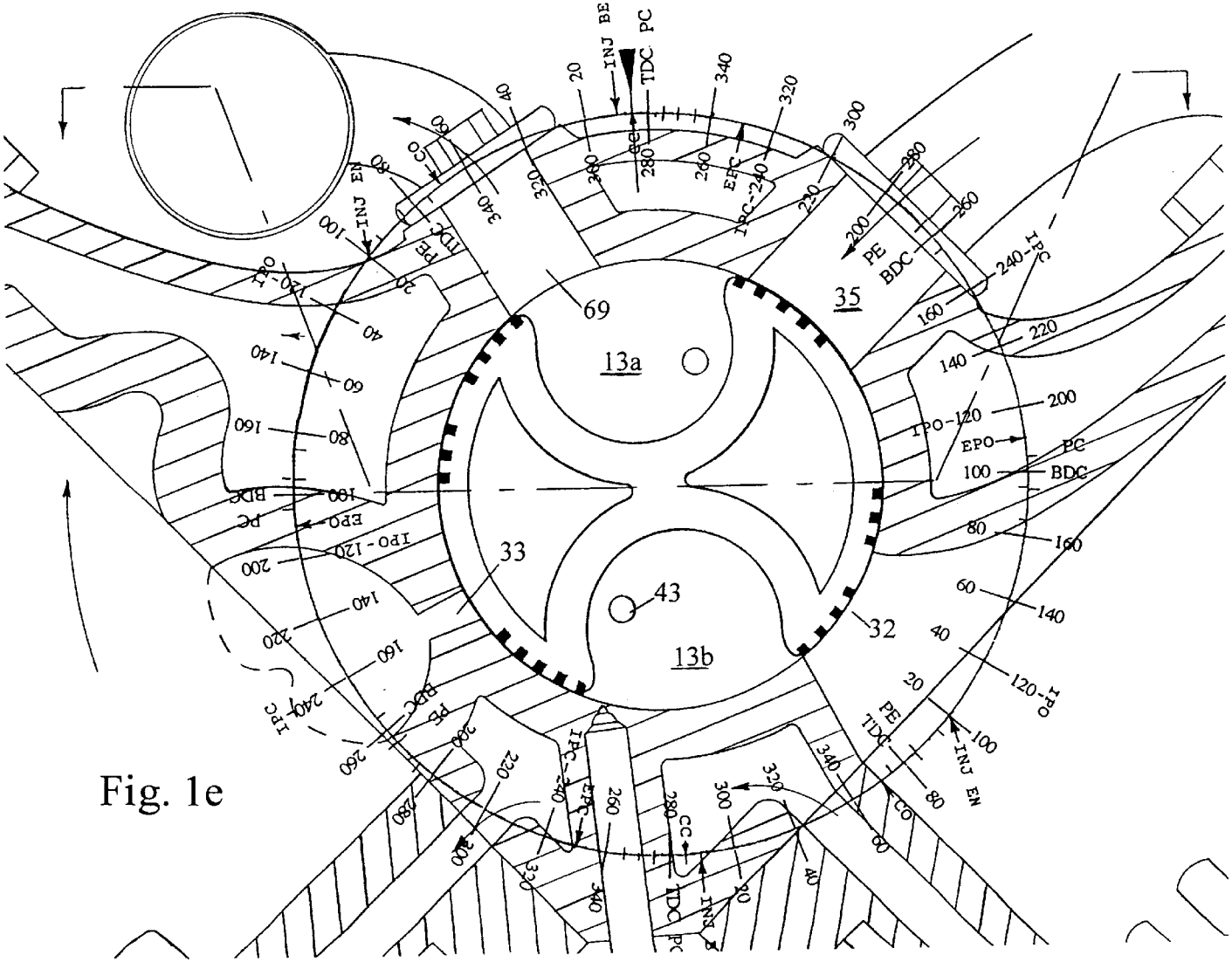
FIG. 1*e* shows a pinwheel diagram of the preferred embodiment.
Figure 1G:
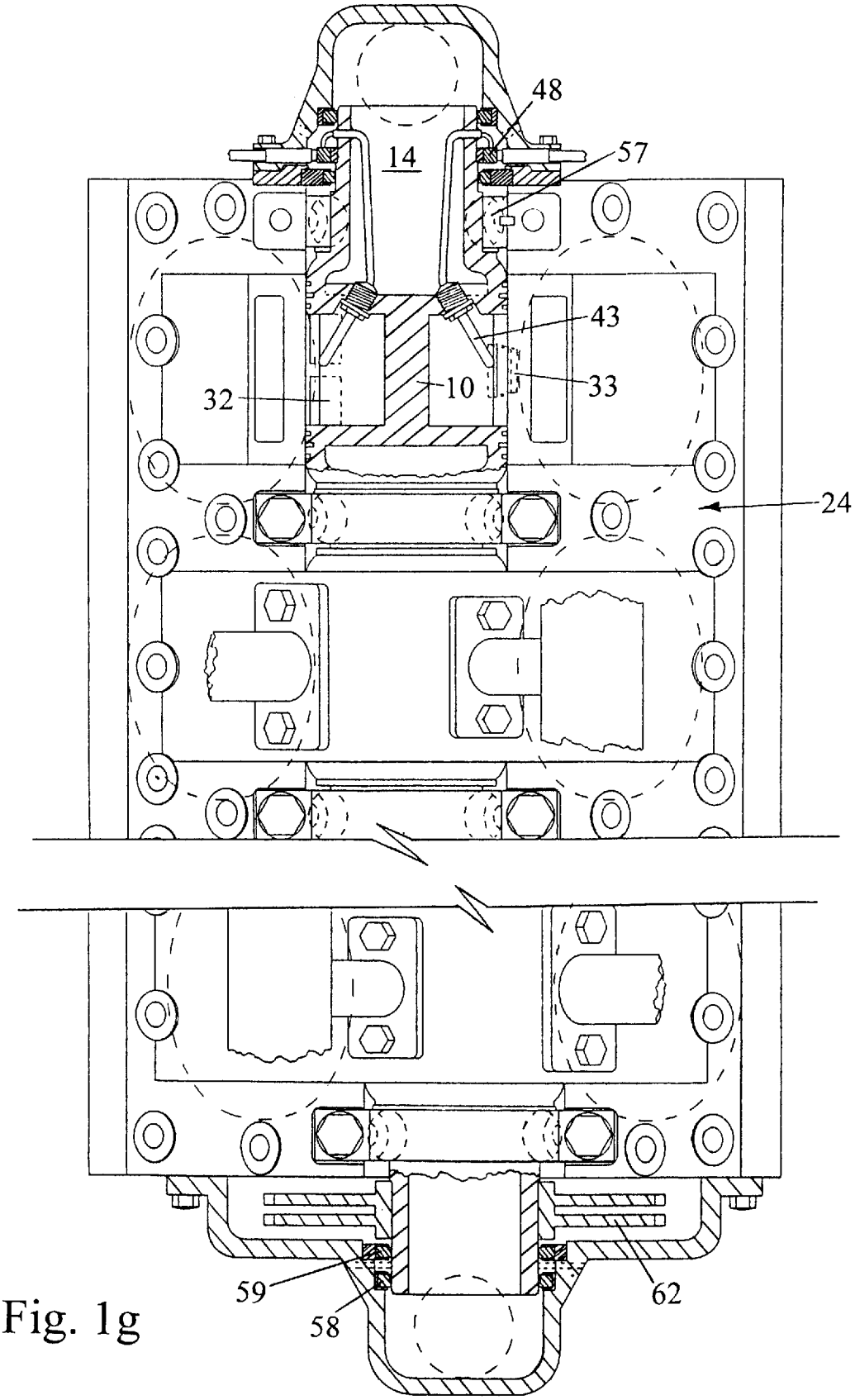
FIG. 1*g* shows a top view of the preferred embodiment.
Figure 1J:
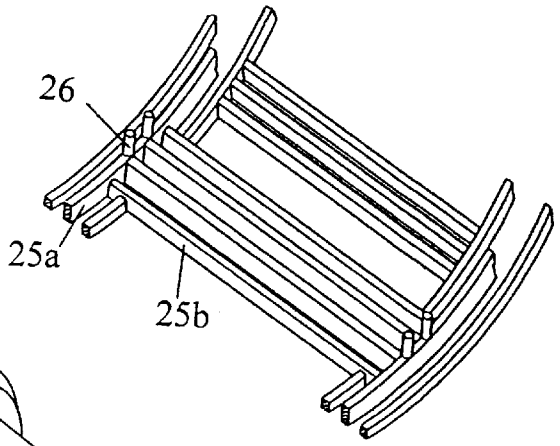
FIG. 1*j* shows a possible ring pack.
Figure 1I:
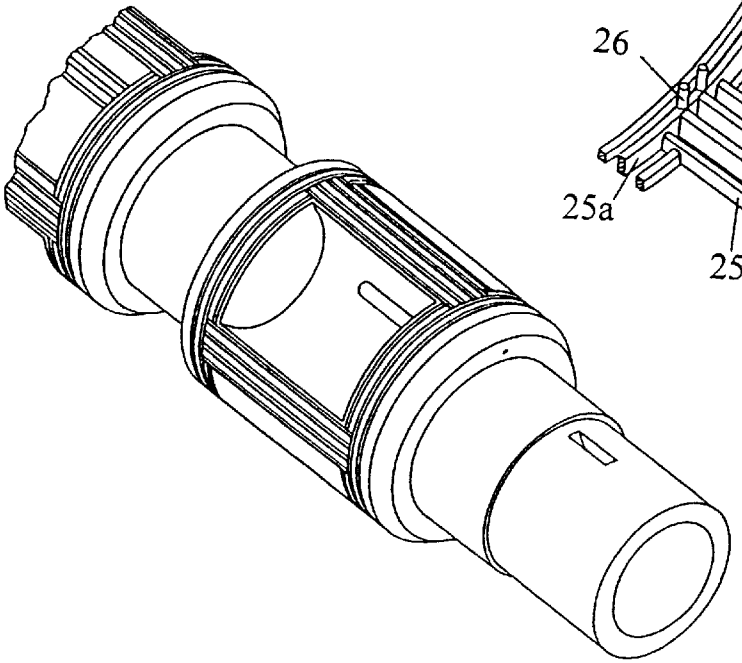
FIG. 1*i* shows a possible combustion housing.
Figure 1H:
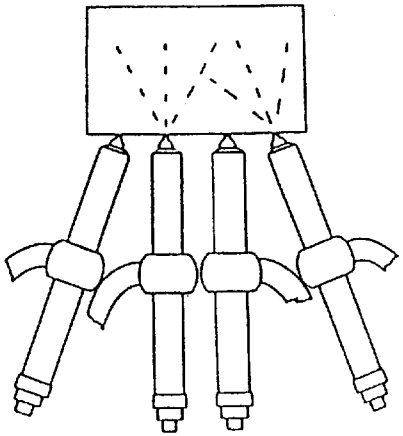
FIG. 1*h* shows a possible fuel injector array.
Figure 1M:
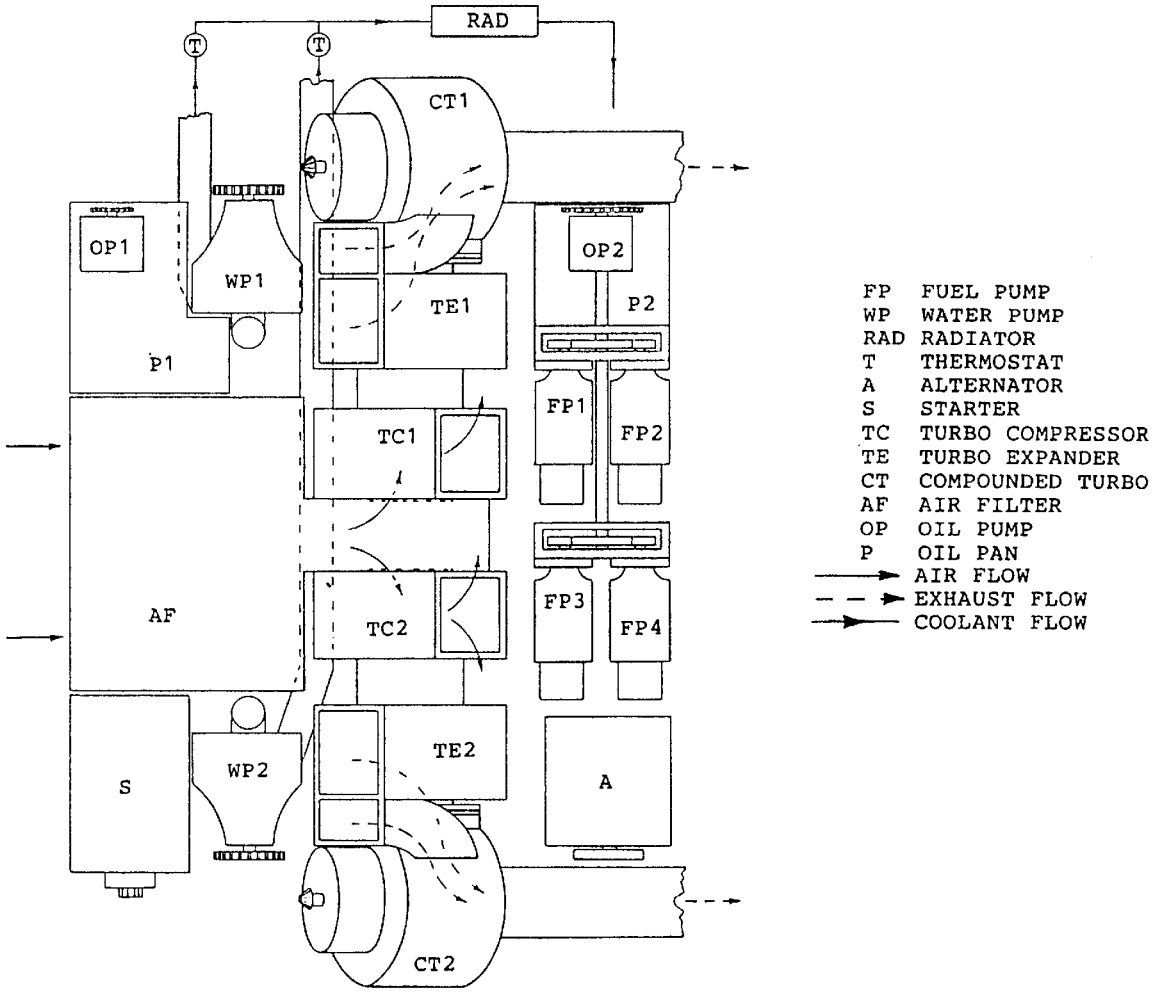
FIG. 1*m* shows a bottom view of the 12 cylinder preferred embodiment.
Figure 1N:
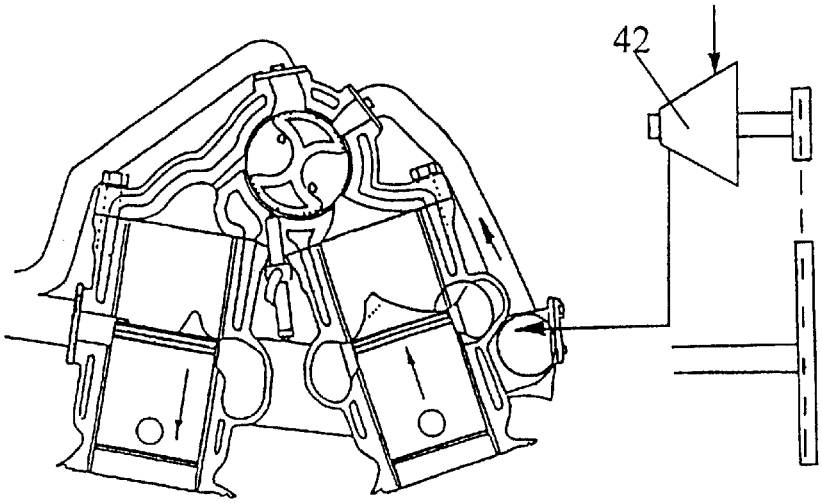
FIG. 1*n* shows a compound turbo compressor charging the engine.
Figure 1O:
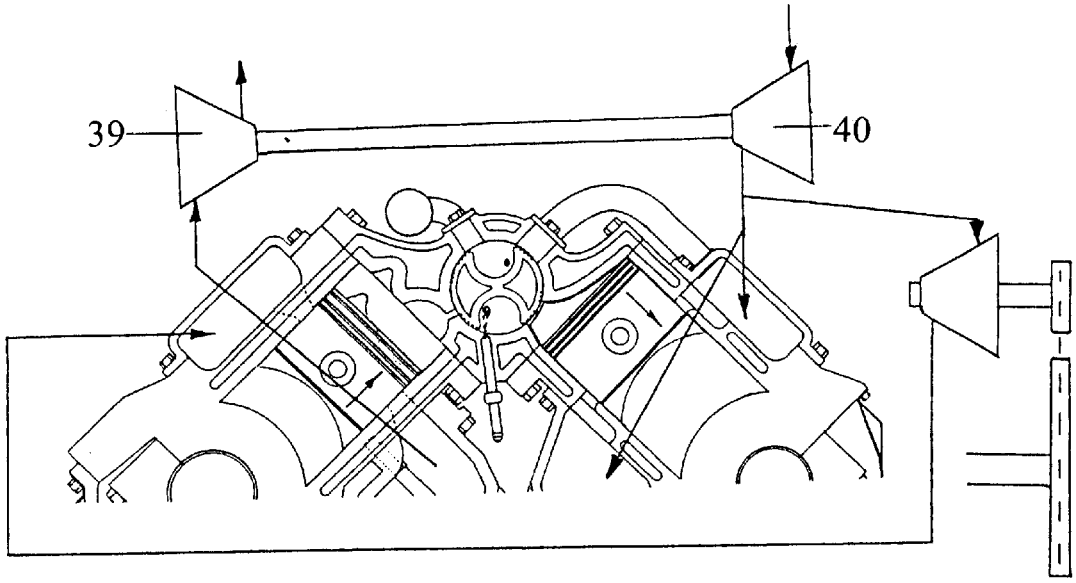
FIG. 1*o* shows a compound turbo compressor and turbocharger charging the engine.
Figure 1P:
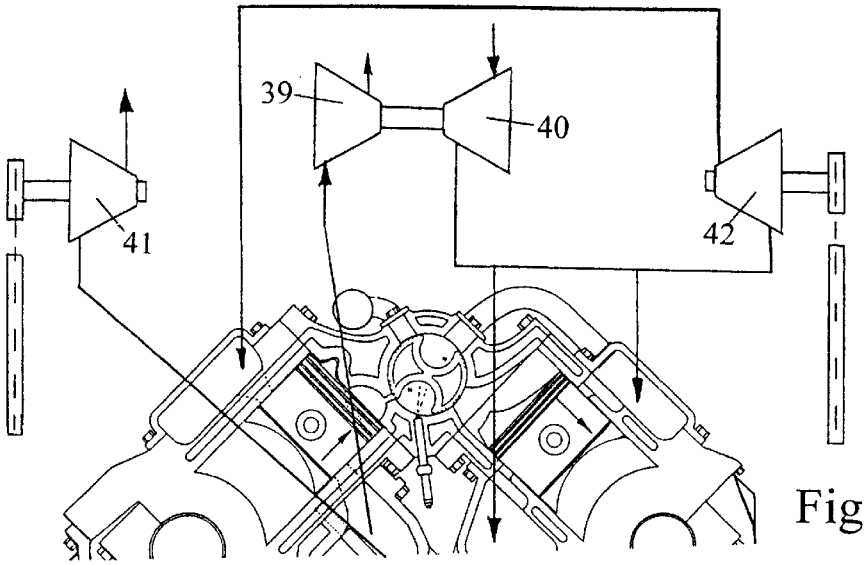
FIG. 1*p* shows a compound turbo compressor, a compound turbo expander, and a torbocharger charging the engine.
Figure 5:
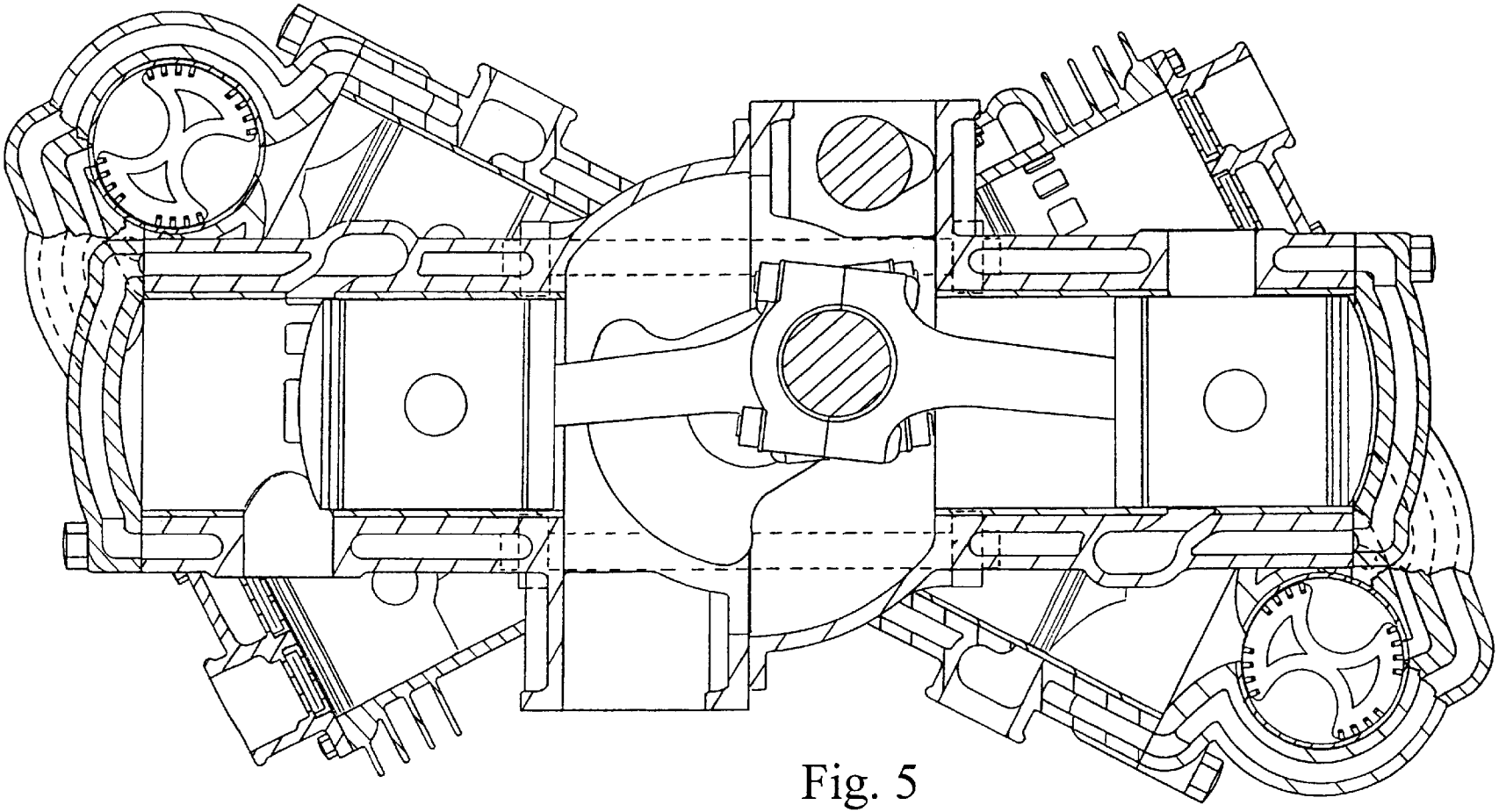
FIG. 5 shows an opposed unit SPE which shares one crank shaft.
Figure 6:
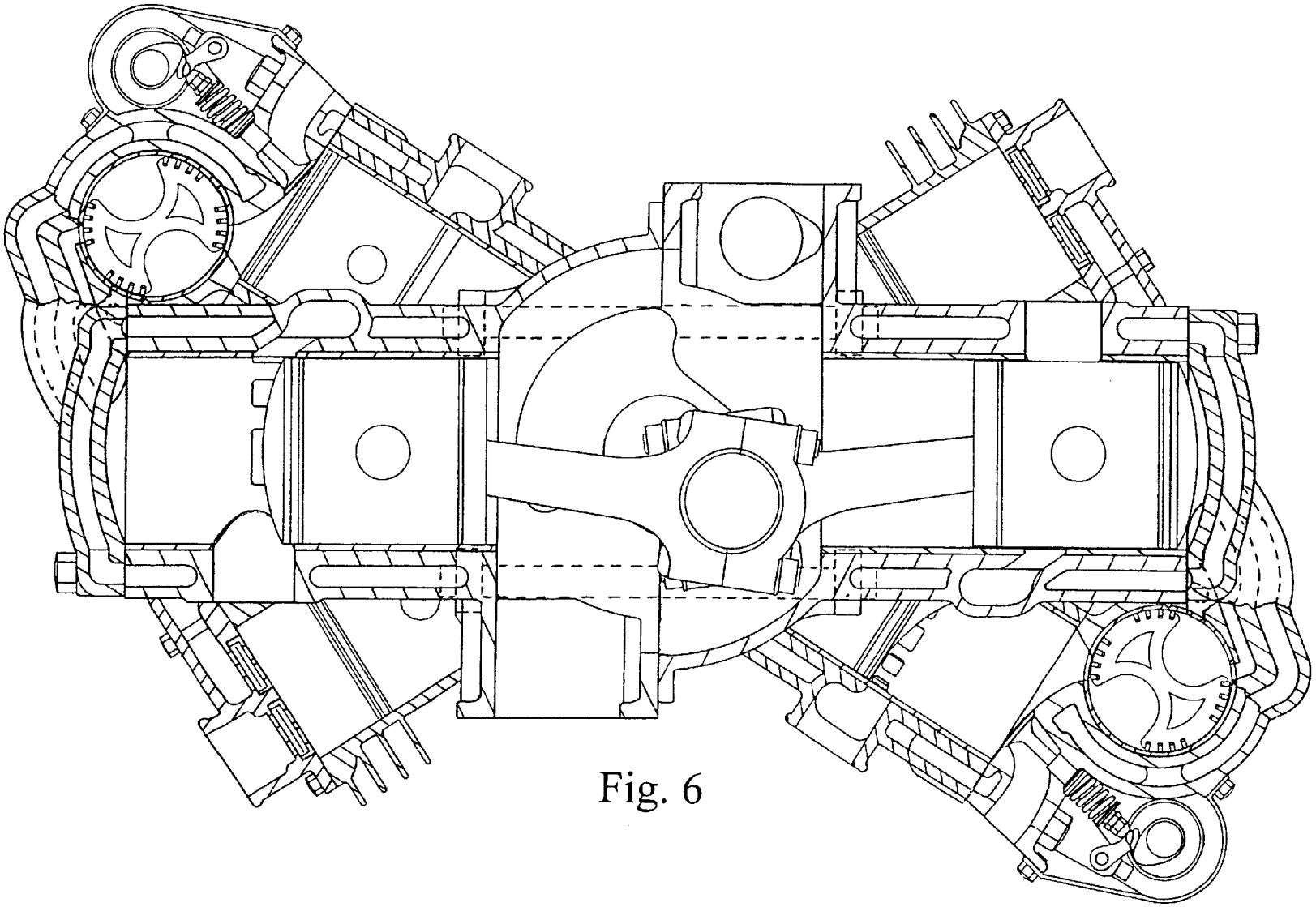
FIG. 6 shows an opposed unit SPE which shares one crank shaft and which incorporates poppet intake valves in the piston compressor.

In the illustrated SPE design of FIG. 1*a,* the degree of lag time between piston processors will have no effect on engine balancing as they are incorporated in two, six cylinder configurations. The piston compressor and piston expander can be placed at any relationship around the head except where the two cranks would intersect. This is shown by FIGS. 1 and 2*a.* The piston compressor and piston expander can also be banked at various angles when a single crank shaft is used as shown in FIGS. 5 and 6. By having separate compressor pistons, this engine can process nearly one hundred percent fresh air every two piston compressor strokes with the compressor pistons. Since the compressor piston experiences only compression pressures and temperatures, and also experiences no sudden rise in pressure due to no combustion carried out in the chamber, it can be made much lighter than the expansion piston. This would be the perfect application for composite pistons, rods, even plastic rings. The compressor piston can be made larger or smaller and operate in the same RPM range as the possible heavier expansion piston due to its lightweight construction.

Any clearance volume of the piston compressor which is not trapped will be re-expanded on the compressor pistons downward stroke. The piston compressor's volumetric efficiency should be superior to an engine using poppet valves especially when operated at higher RPMs. This is due to the large intake port area and cooler operating temperatures due to no combustion carried out in the piston compressor.

The residual gas in the piston compressor and combustion chambers should aid in controlling peak pressures and allows burning a higher air fuel ratio of the fresh air as pressure and temperature energies are absorbed by the inert gas. It also raises the initial temperature of the fresh air.

More space possibly will be required between in line expansion pistons due to stronger bearing surfaces and block integrity as would be similar in a diesel engine of higher peak pressures. Compressor pistons could be made with larger bores than the expansion pistons as they could be placed much closer together because of lighter bearing surfaces and lower temperatures. The larger pistons would occupy a very small additional space due to tighter packaging.

Figure 1Q:
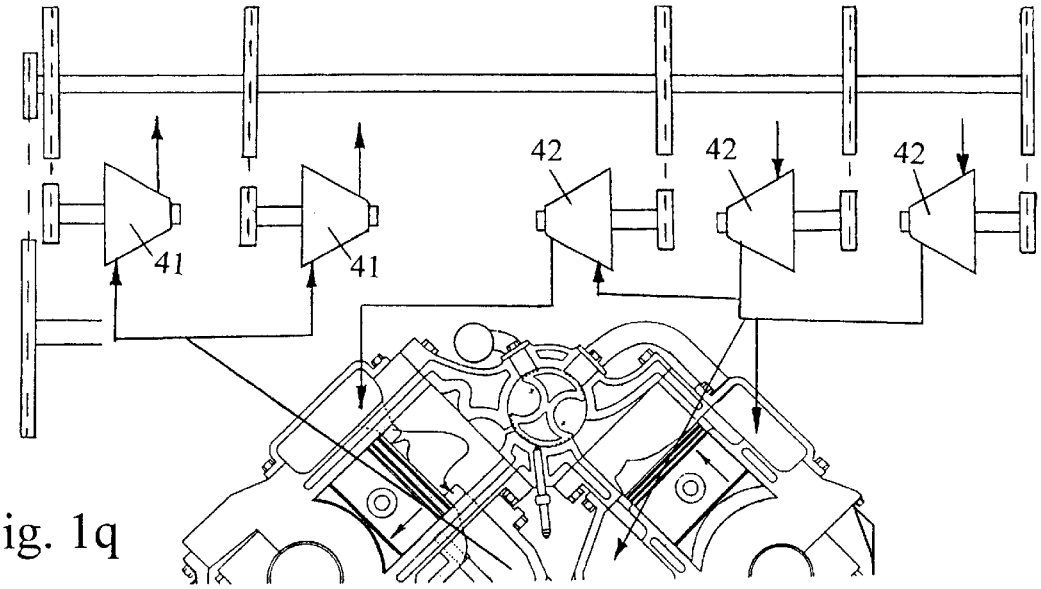
FIG. 1*q* shows a compound turbo compressor and turbo expander system.
Figure 2A:
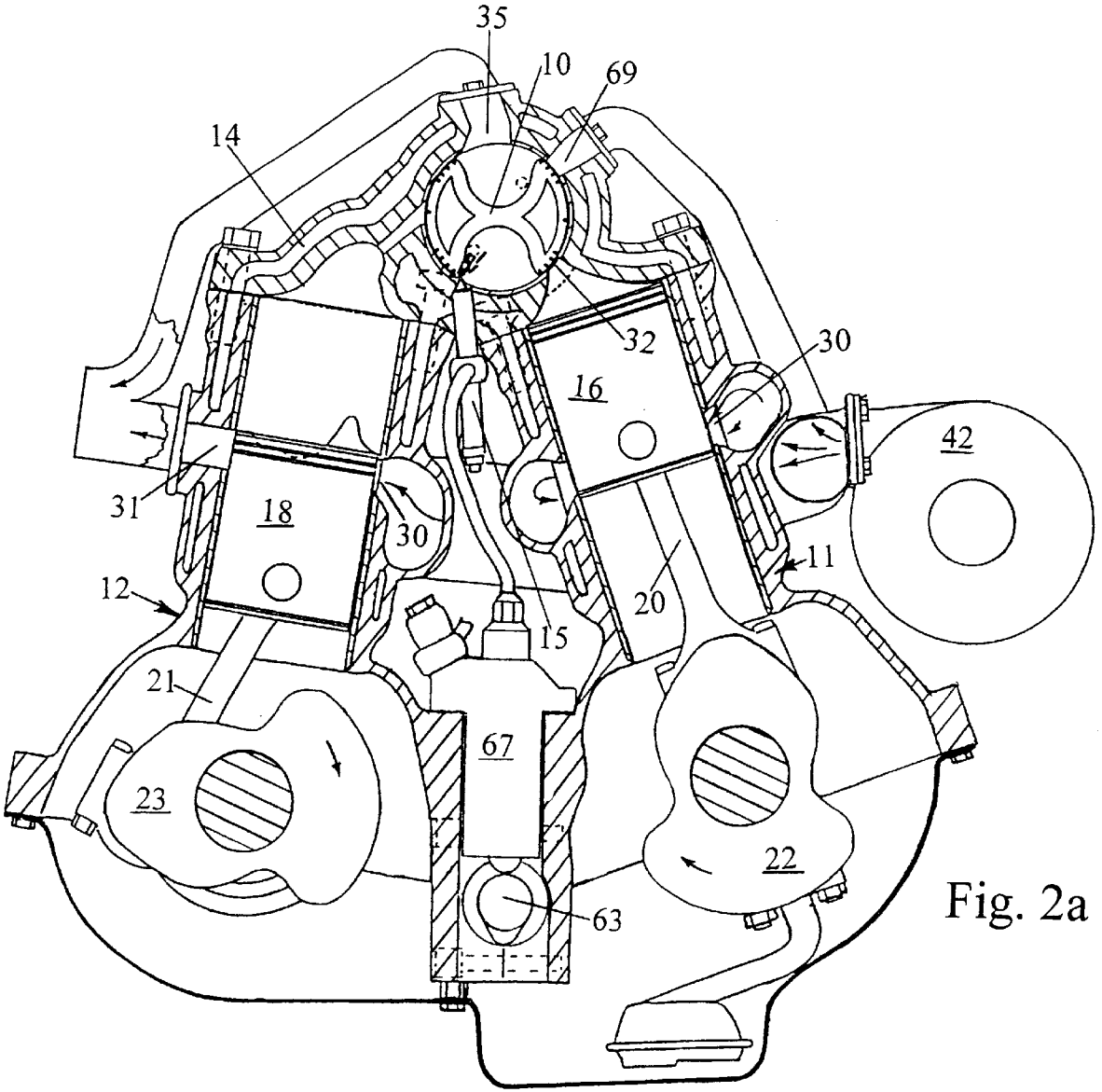
FIG. 2*a* show a single unit two cylinder embodiment with different angularity of the piston processors relation to the head cylinder and combustion housing.

If all turbines 41 & 42 are compounded, then the SPE engine can be run as a gasifier with a higher exhaust pressure than intake pressure as shown in FIG. 1*q*. This combustion system should allow running at very high RPMs limited by rod integrity. Each of the two migrating combustion chambers on opposite sides of the combustion housing share the same head cylinder and have at least one or more injectors which operate once every four strokes or 720 degrees. The one or more injectors used for the first combustion chamber operates 360 degrees out of phase of the second combustion chamber's injectors. This also allows for high speed operation. One possible injector array is shown in FIG. 1*h*. In this array, two injectors inject into one combustion chamber at the same time while two other injectors inject into the second, opposite combustion chamber. The injectors can be single hole, low pressure components due to the long constant volume injection time and the mixing of gas during migration between chambers. The injectors are supplied by a fuel pump 67 which is activated by a cam 63 or the fuel can be controlled with electronic injectors.

By adding additional volume to the piston expander's volume, gas is increased without an increase in compression pressures of the combined gases; unlike the high final compression pressure created by boosting typical four stroke diesel engines. The gas can be injected into and burnt prior to expansion, and the Otto cycle can be nearly completed except for the short expansion of the gas. This can be recovered with turbochargers to do work on cooling, boosting, and work input to the crankshaft when compounding turbochargers. This compounding allows tying of the turbochargers' RPMs and exhaust pressures while producing varied boost. This can be achieved by having linked to one turbo expander a low boost centrifugal compressor which processes all the fresh gas, and a second compressor linked to the second turbo expander which boosts nearly half the prior low boost fresh gas to higher than exhaust pressure for scavenging. The compounding of turbochargers will produce sufficient boost with lower exhaust energies by taking energy from the shaft work. During operation of extreme high boost and low piston expansion of relative gas, the turbos should provide positive shaft work. This should also even out the power lag during acceleration. FIG. 1*p* shows a configuration using a turbo expander linked to turbo compressor, a compound turbo expander and a compound turbo compressor. An additional compounded turbo compressor can be added to the standard turbocharger to supply the intake manifold of the piston expander for enhanced over scavenging as shown in FIG. 1*o*. FIG. 1*q* illustrates a turbo configuration in which all turbos whether compressors or expanders are compounded. In this design two shafts are rotated using a chain or belts or other rotary transmission means which are driven by the expansion crank. The shafts are belted to the various turbos at selected RPMs to enhance turbine performance. This also allows running the engine as part engine and part gasifier with exhaust turbo inlet pressures higher than intake turbo outlet pressures.

This engine will have the ability to burn alternate fuels such as natural gas better than any engine to date. The constant volume time can be set by the spacing of the head cylinder porting and relative positioning of the piston compressor to the piston expander. This allows the building of engines in which the constant volume time is designed for the proper induction/combustion time for each particular fuel. If both the piston compressor and the piston expander have separate crank shafts, then any relational positioning of the two processors around the head is achievable, except where the cranks would intersect as shown in FIGS. 1*a* and 2*a*. The angles in which the cranks intersect can be achieved by using a single crank engine.

The whole engine can be water cooled especially the constant volume combustion chamber housing of which the combustion chambers are an integral part. The various blocks can incorporate a water jacket 14. FIG. 1*g* illustrates the combustion chamber housing coolant flow and the coolant seals 58 with a seal supporting unit which bolts to the head. Other types of liquid coolants can be used or air cooling can be used to raise the temperature of the combustion chambers. Combustion housing oil seals 59 can be used to contain the oil around the combustion housing. Also illustrated is the combustion housing mounting into the head using journal bearings and journal caps. Roller, needle or other types of bearings could also be used. A cutaway of the head and housing is illustrated showing commutator to glow plug energizing via brushes.

FIG. 1*a* illustrates the configuration of one preferred embodiment of the SPE engine. Belts, chains or other rotational transmission devices which are used to drive water pumps, oil pumps and other devices are shown in hidden lines.

FIG. 1*ba,* 1*bb,* and 1*bc* illustrates the mechanical positions of the SPE pistons and combustion housing at three key timing events of charging, injection, and beginning of blowdown or the combining of the combustion chamber with the expansion chamber.

FIG. 1*ca,* 1*cb,* and 1*cc* illustrates possible compressor/combustion induction ports and combustion/expander exit port shapes with openings and closures of the combustion chambers relative to the respective pistons crank angles which are in communication with these particular ports shown in hidden lines.

More than one port opening can be used for the compressor/combustion induction port and combustion /expander port openings. This will aid in transferring the rings over the port openings and possibly enhance combustion as several combustion chamber/expander ports can be directed in various ways to cause better mixing of the air and fuel.

FIG. 1*d* illustrates a possible engine cycle graphed in pressure versus time. The piston compressor's cycle is shown in a line with triangles while the piston expander's cycle is shown in a line with squares. The graph shows two complete revolutions of the crank shafts or 720 degrees of travel. Since the combustion housing rotates at one half the RPM of the crank shafts, it is graphed in one revolution. VS designates the time when the combustion chamber is separated from the piston compressor's chamber. VC designates the time when the combustion chamber opens to the piston expander's chamber. Since both the combustion chamber volume and the piston expander volume have been compressed and are storing energy, no energy is lost by combining them before expansion. One energy state goes up while the other goes down. Mass is conserved and energy is conserved. The volumes do not change, they simply combine.

I have chosen to use pressure/time or pressure/crank angle graphs. Pressure volume graphs are quite confusing as volumes are removed and added throughout the cycle. The combustion chambers experience no volume change during the constant volume injection time and are graphed with pressure over time. By showing the four components in pressure over time the graphs can be tied together and overlaid. Note the 720 degree cycle of the combustion chamber A as shown in lines with circles. The last trace of combustion chamber B shown in a line with crosses is exactly the same as combustion chamber A except it is 360 degrees out of phase. As the graph points out temperatures and pressures are controlled by mechanics. The graphs point out the low temperature and pressures experienced by the compressor pistons. The peak piston pressures and temperatures can be set for both the compressor pistons and the expansion pistons by their compression ratio and maximum boost. The graphs also show that the combustion housing can take the brunt of the heat and pressures. This housing can be water cooled with a high volume coolant flow.

The combustion chambers, which are located in the combustion housing, can be fitted with ceramic chamber inserts if high efficiencies are needed or if they are operated in an extreme pressure or temperature range. The expander piston's restricted throat and chamber can also be fitted with a ceramic insert. The combustion chambers are supremely sturdy and could withstand extreme pressures. The surface to volume in the combustion chamber is very small limiting heat loss. The 720 degree cycle of the combustion chambers allow for possible dumping to atmosphere after dumping down to the turbochargers. There is also plenty of time for scavenging of the combustion volume. These factors enhance cooling time and fresh air addition.

FIG. 1*e* is a pinwheel representation of the combustion housing rotation as compared to piston crank angles. The outer timing marks on the pinwheel refer to the relative crank angle positions of the piston expander. The inner timing marks on the pinwheel refer to the relative crank angle positions of the piston compressor. All the timing marks correspond to a timing line which is at the top and center of the illustration as a line with a large triangle. All timing marks refer to after top dead center positions. If the combustion housing and numeral wheel were rotated clock wise and separated from the rest of the figure it would illustrate the relative positions of the compressor piston, expansion piston, and the combustion housing. FIG. 1*e* also illustrates 9 key events which are letter coded. IPO is when the intake port opens, EPO is when the exhaust port opens, IPC is when the intake port closes, EPC is when the exhaust port closes, CO is when the combustion chamber opens, CC is when the combustion chamber closes, INJ BE is when injection begins, INJ EN is when injection ends, and GP is a possible location of the glow plug. FIG. 1*e* shows a crank shaft relationship of the compressor crank and expander crank of 80 degrees out of phase with each other.

FIG. 1*f* illustrates possible shapes of the expander piston and the compression piston. A possible glow plug assembly is also illustrated on this figure.

FIG. 1*g* illustrates a perspective view which is a partial break away of the SPE head as taken from FIG. 1*e*.

FIG. 1*k* shows various ports in the head cylinder. Possible locations of oil injection ports located in the head cylinder are shown in this perspective. Oil injection ports can be placed throughout the head cylinder to provide proper lubrication. Oil ports can be placed directly under the ring paths to promote a boundary layer condition between the ring and cylinder.

FIG. 1*i* shows a break away of the combustion housing which would house twelve combustion chambers in the twelve cylinder SPE version.

FIG. 1*l* shows possible combustion chamber housing journal bearings and caps which secure the combustion chamber housing within the head.

FIG. 1*j* shows one possible ring configuration which would be placed into the combustion housing ring grooves for sealing volumes within the head. Rings can be constructed at various heights as to not allow various rings to share the same ring crevice or clearance volume. Ring pins are placed inside the combustion housing after drilling in the various ring grooves. These ring pins slow the passage of gas through the ring clearance volume and isolate the pressures.

FIG. 1*h* also illustrates one possible injector array needed to supply two opposing combustion chambers.

FIG. 1*m* illustrates the top view of the twelve cylinder engine. Air, exhaust, and coolant flow are illustrated with corresponding arrow symbols. The lines ending with arrow heads designate air flow. Hidden lines ending with arrow heads designate exhaust flow. Arrows in the middle of lines designate coolant flow.

FIG. 1*n* illustrates a packaging of components where a turbo compressor is compounded to boost intake pressures.

FIG. 1*o* shows a turbocharged SPE with an additional compound turbo compressor used to boost intake pressures further to scavenge the piston expander. The compound turbo compressor is optional in FIG. 1*o* as the engine can be run with typical turbocharging as would be illustrated if the compound turbo compressor were removed from this figure.

3. ALTERNATE EMBODIMENTS

The FIGS. 2*a* through 2*j* are illustrations of a single unit SPE engine. Its cycle is the same as described in the earlier writing except the compression crank and expansion crank are set at 120 degrees out of phase of each other and the ports are moved farther apart. This allows operating at higher revolutions per minute of the engine.

FIG. 2*a* illustrates one possible configuration of a single unit two piston SPE. The compressor block and expander block are located much closer together than the twelve cylinder version. Also, the fuel pump is mounted between the two separate crank cases. The radiator and belting or chaining are shown in hidden lines.

Figure 2B:
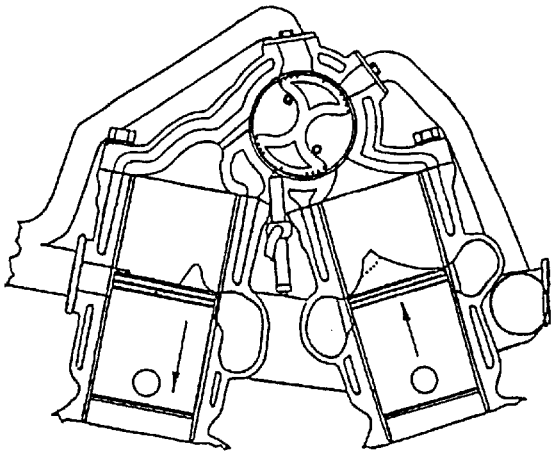
FIG. 2*ba* shows the beginning of loading the combustion chamber via the piston compressor while the piston expander is scavenged.
Figure 2B:
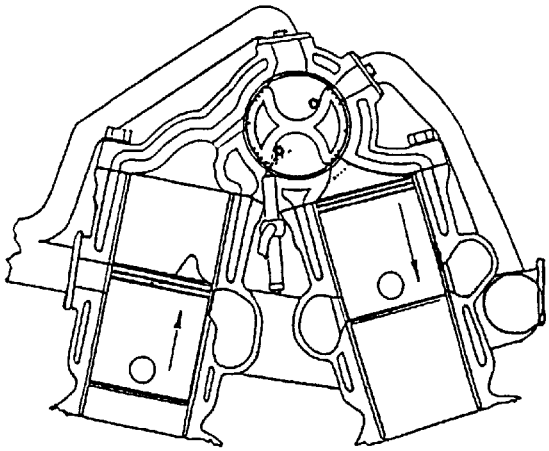
Figure 2B:
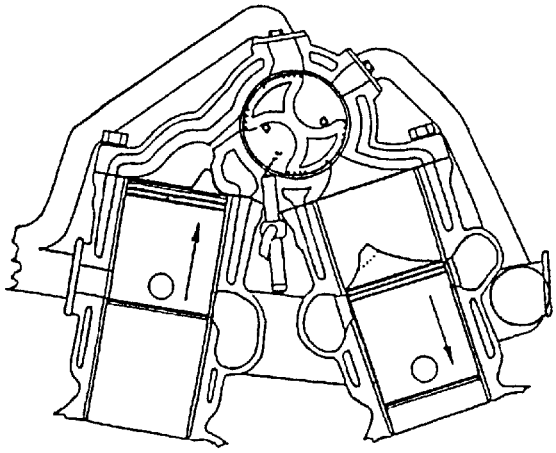

FIGS. 2*ba,* 2*bb,* and 2*bc* illustrate the mechanical positions of the SPE pistons and combustion housing at three key timing events of charging, injection, and beginning of blowdown or combining of the combustion chamber with the expansion chamber.

Figure 2C:
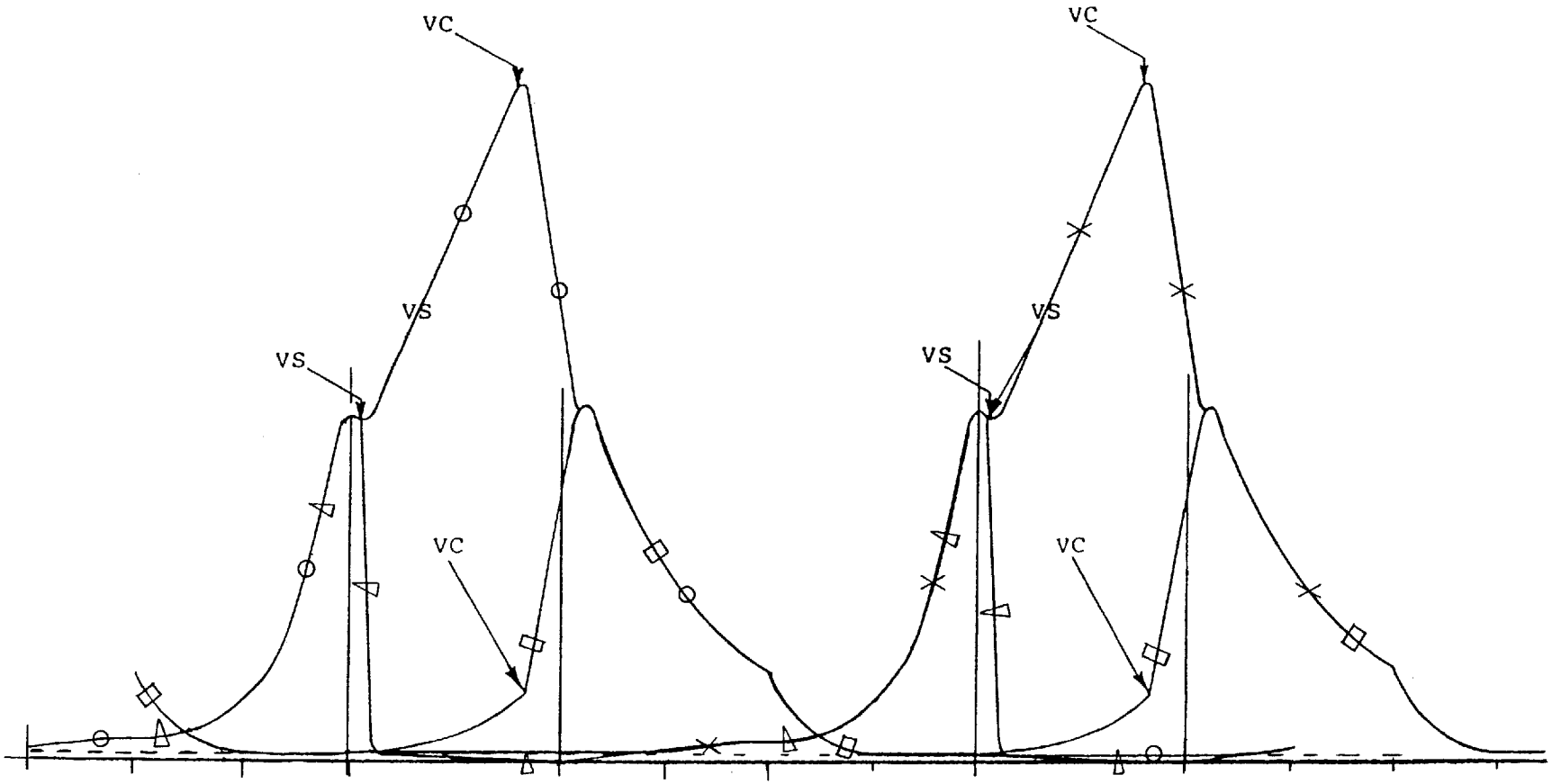
FIG. 2*c* shows a possible pressure trace of the processing chambers.

FIG. 2*c* illustrates one possible pressure verses crank angle graph of the four chambers. The graph in triangles represents the piston compressor's pressure trace over time. The graph in squares represents the piston expander's pressure trace over time. FIG. 2*c* illustrates two complete revolutions of both the compression crank and the expansion crank. The two combustion chambers pressure traces are shown with circles and crosses. Since the combustion housing revolves at ½ the speed of the crank, it is shown in one revolution. Key timing events are letter coded where the letter key is included in the top right hand area of the figure. VS represents the moment in which the piston compressor's chamber separates from the relative combustion chamber. VC represents the moment in which the relative combustion chamber opens to or communicates with the piston expander. The piston compressor is boosted by a compound turbo compressor.

Figure 2D:
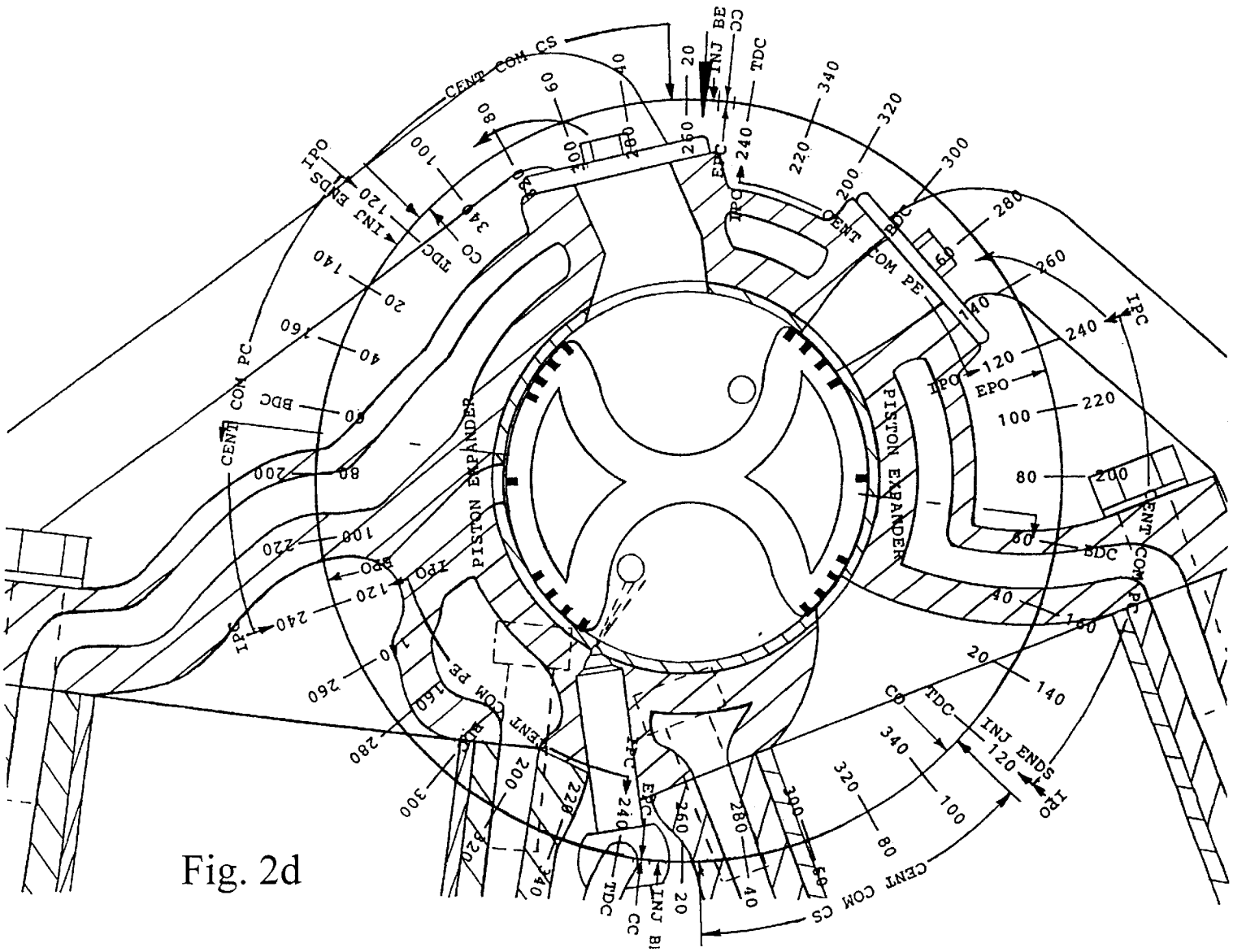
FIG. 2*d* shows a pinwheel diagram of the preferred embodiment.

FIG. 2*d* illustrates the relative positions of both pistons and combustion volumes in the combustion housing. The outer timing marks of the pinwheel are the relative positions of the piston compressor's crank angles. The inner timing marks of the pinwheel are the relative positions of the piston expander's crank angles. All timing numbers refer to after top dead center position and correspond to a timing mark as a line with a large triangle at the top of the head. Letter codes of key events are included on the pinwheel and are the same as FIG. 1*e*. The turbo compressor is used to charge the piston compressor until the piston compressor's induction ports close at which time the piston expander's induction ports open and the turbo compressor is then used to scavenge the piston expander. Shortly after the piston expander's induction ports close, one of the combustion chambers opens to the combustion chamber exhaust ports 68. When the combustion chamber is also open to the combustion scavenging port 69, the turbo compressor is used to scavenge one of the combustion chambers. The letter key as follows refers to the duty cycle of the compounded turbo compressor. CENT COM PC is when the blower is boosting the piston compressor, CENT COM PE is when the blower is scavenging the piston expander, and CENT COM CS is when the blower is scavenging a combustion chamber.

Figure 2E:
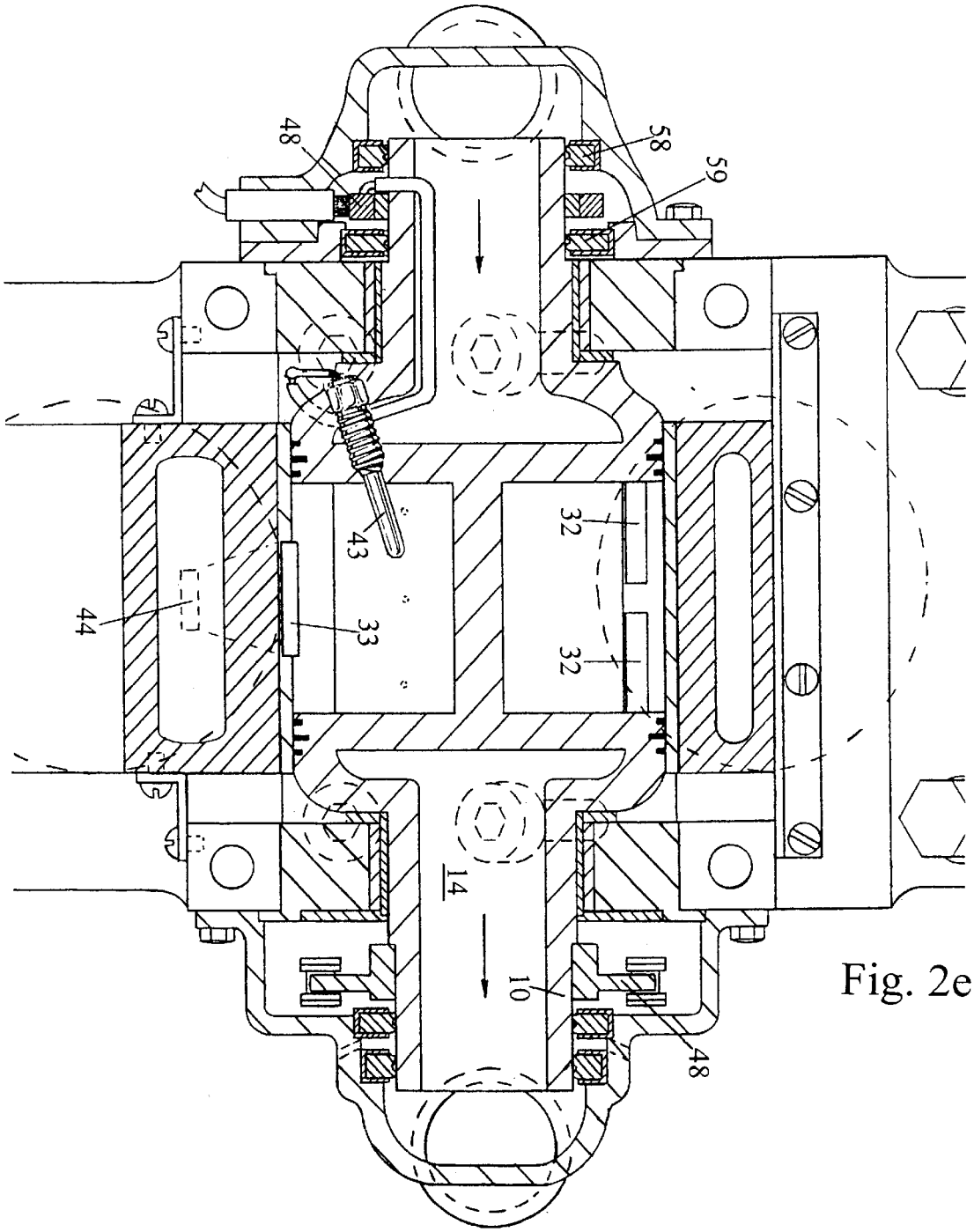
FIG. 2*e* shows a sectional top view of the preferred embodiment.

FIG. 2*e* illustrates a cut away top view of the head and combustion housing. A commutator and brush are used to energize the glow plugs in the rotating combustion housing which are used to allow start up with low compression ratios. Glow plugs can be directly injected onto during start up and until a high enough boost pressure from the turbo compressor is attained to continue auto ignition without the glow plugs. Glow plugs can be continually energized for continuous low compression operation.

Figure 2G:
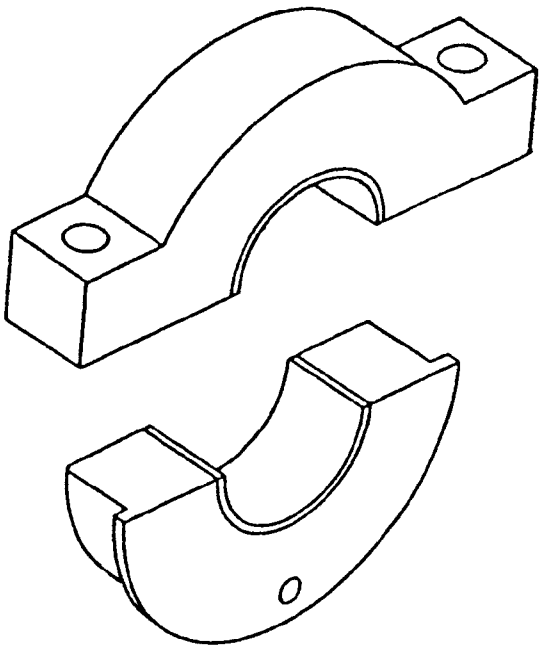
FIG. 2*g* shows a combustion housing journal bearing.
Figure 2F:
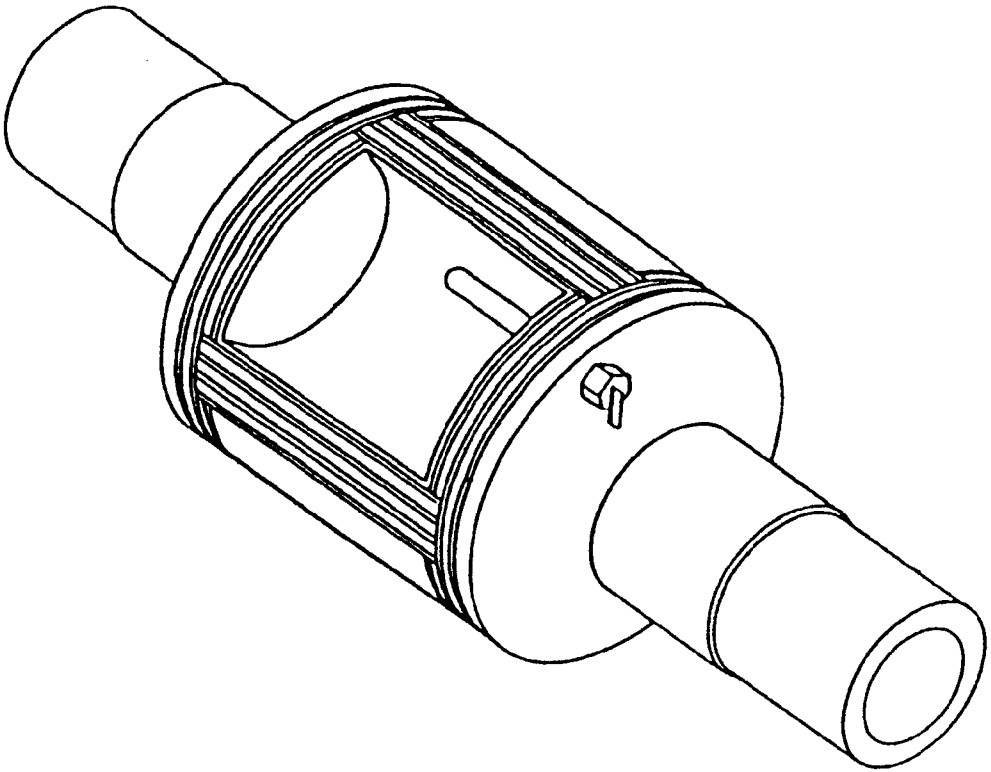
FIG. 2*f* shows a possible combustion housing.
Figure 2H:
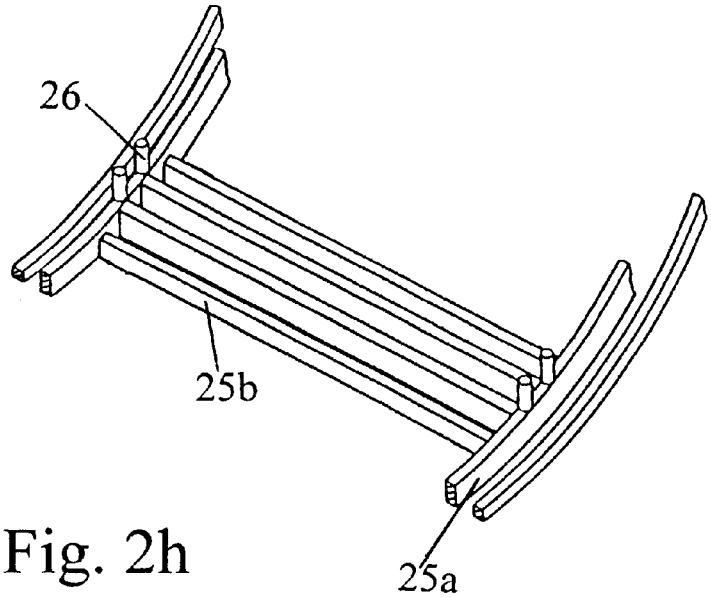
FIG. 2*h* shows a possible ring pack.
Figure 2I:
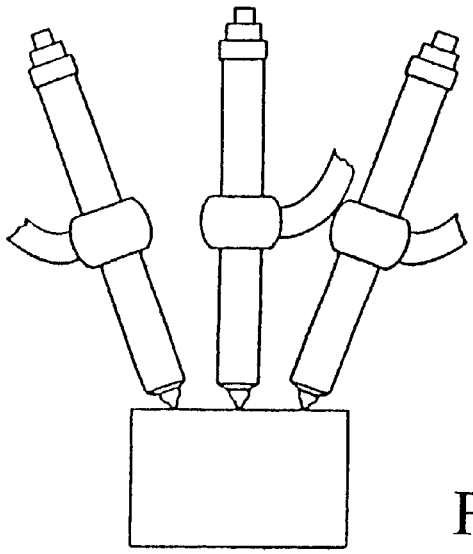
FIG. 2*i* shows a possible fuel injector array.
Figure 2J:
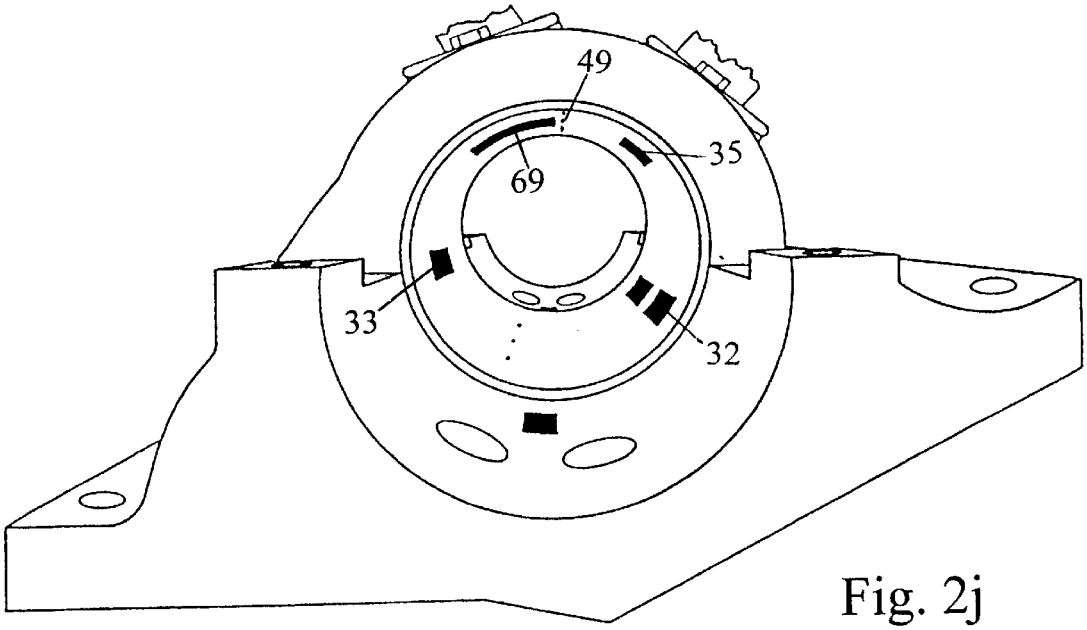
FIG. 2*j* shows a partial view of the head of the preferred embodiment.

FIG. 2*j* illustrates a perspective view of the head with the combustion housing removed. Notice the various ports in the head cylinder. Fuel injector and lubricating oil injection holes are also shown in this figure.

FIG. 2*f* shows an isometric view of the single unit combustion housing.

FIG. 2*g* shows one possible journal bearing and cap.

FIG. 2*h* shows a possible combustion housing ring pack.

FIG. 2*i* shows a possible injector array. Three injectors can be used rather than two to keep the injector pump speeds within operating limits. Only one injector operates in sequence with the other two injectors every time a combustion volume rotates over the injector nozzels. This is achieved by running the injector pump at ⅓ the RPM as that of the cranks.

Referring again to FIG. 2*a*: In this figure the crank cases are oil filled and journal bearings are used. Another configuration of the SPE can be much the same as FIG. 2*a* except the crank cases can be made 2 cycle in nature using needle bearings for piston rods, and ball or needle bearings for mounting of the crank journals. In this completely two cycle version, the piston expander's crank case can be used for induction and scavenging of the piston expander. The compressor piston's crank case can be used to induct fresh air and to charge the expander piston's crank case for enhanced overscavenging.

FIG. 3*a* shows a completely two stroke version which is of opposed piston design. This embodiment is shown using optional split injection.

Figure 3B:
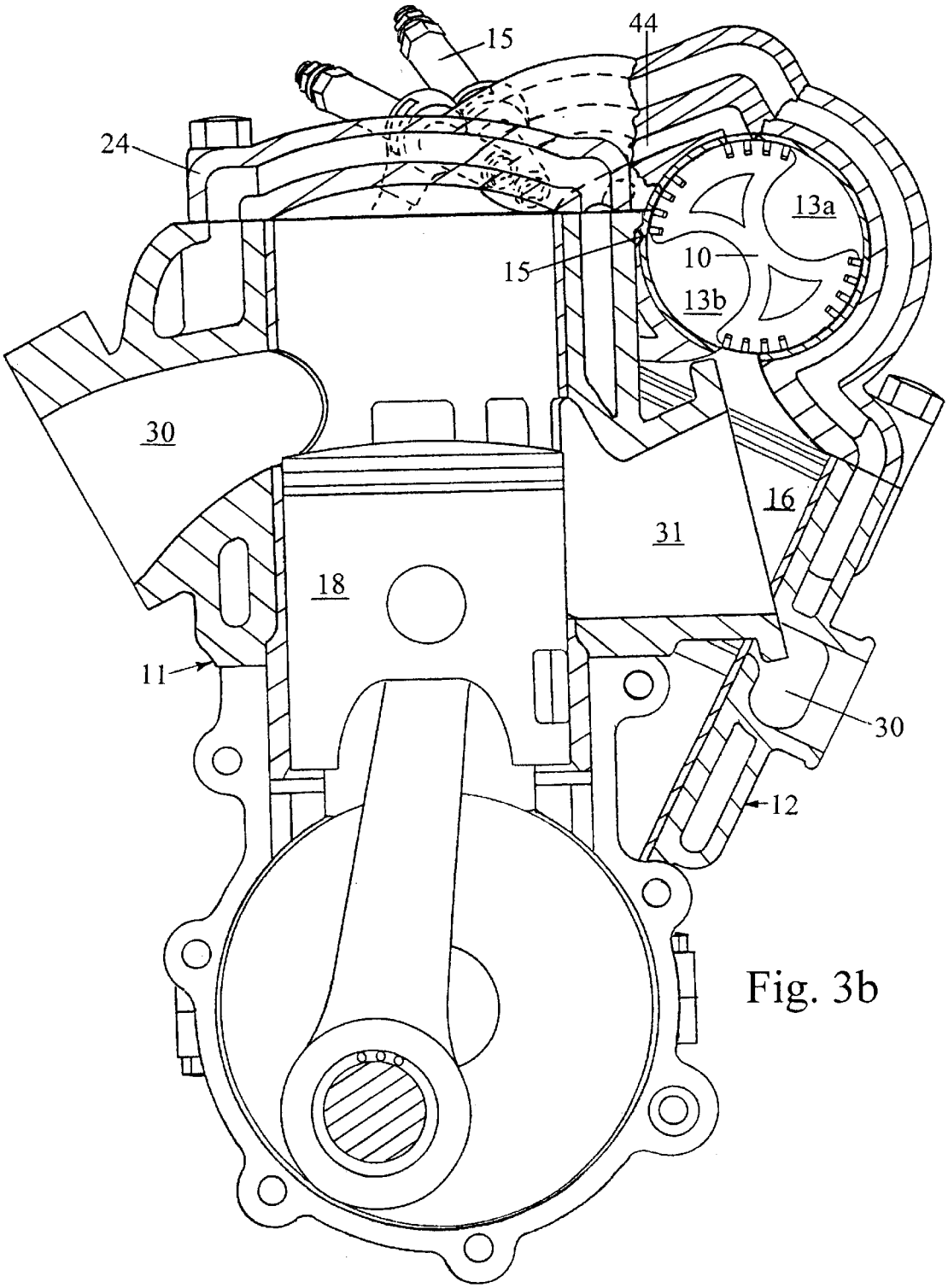
FIG. 3*b* shows a single crank crankcase scavenged SPE.

FIG. 3*b* illustrates one such completely two cycle version but one in which a single crank is used for both the piston compressor and the piston expander. In this version, the gas cycle is nearly the same as the preceding SPE versions except no combustion chamber scavenging port or combustion chamber exhaust ports are used. Also no compressor crank to expander crank drive chain or advance system are used. Slightly after the crank case intake port is closed and near the beginning of the downward stroke of the expander piston, the crank valve or rotary valve (not shown) can open allowing air from the compressor crank case, which is pre-charged because the compressor is near the bottom of its stroke, to enter the expansion crank case to charge it with more air. This additional charging of the piston expander's crank case allows scavenging flows above unity.

FIG. 4 represents the same configuration as FIG. 3*b* except a scavenging pump is added consisting of a scavenge piston 52, a scavenge cylinder 53, and a scavenge head 55. The scavenge pump enhances scavenging and balancing. Both the scavenging piston rod and compressor piston rod share the same crank journal or are joined by some joining of the connecting rods. Since both the scavenging piston and the compressor piston near bottom dead center near the same time, they can be used to compress the air loaded into the compression crank case from the intake ports and reed valves into the scavenge cylinder and compressed air plenum 54. The scavenging piston pump can induct both through reed valves or flutter type valves 66 and scavenge intake ports 56 near the bottom of its cylinder (if used). The scavenging pump compresses air into the compressed air plenum via the exit port and reed valves. The compressed air plenum is connected to the piston expanders scavenging intake ports. The compressed air is trapped in the compressed air plenum and scavenges the expansion piston when the scavenging intake ports are open. The piston expanders crank case can be oil filled allowing the use of plain bearings. Using plain bearings will allow higher peak expander piston chamber pressures and will yield higher efficiencies.

FIG. 5 illustrates the same configuration as 4 but it shares its crank and crank case with opposing cylinders FIG. 6 shows an opposed cylinder version where poppet intake valves are used to load the piston compressors. This would be an ideal configuration for turbo charging.

Figure 7A:
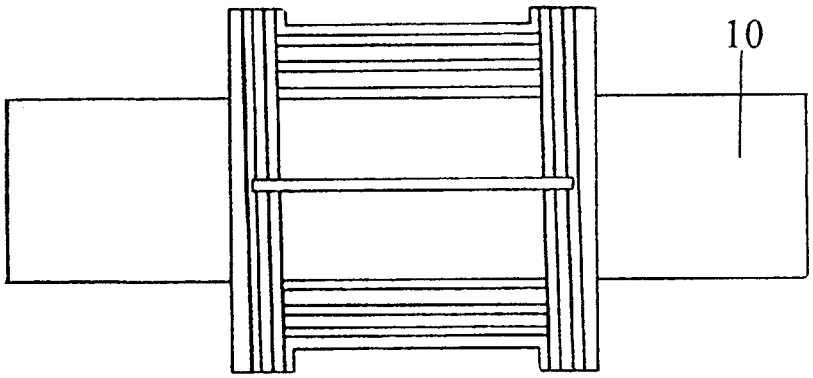
FIG. 7*a* shows a possible single unit combustion housing and ring configuration.
Figure 7C:
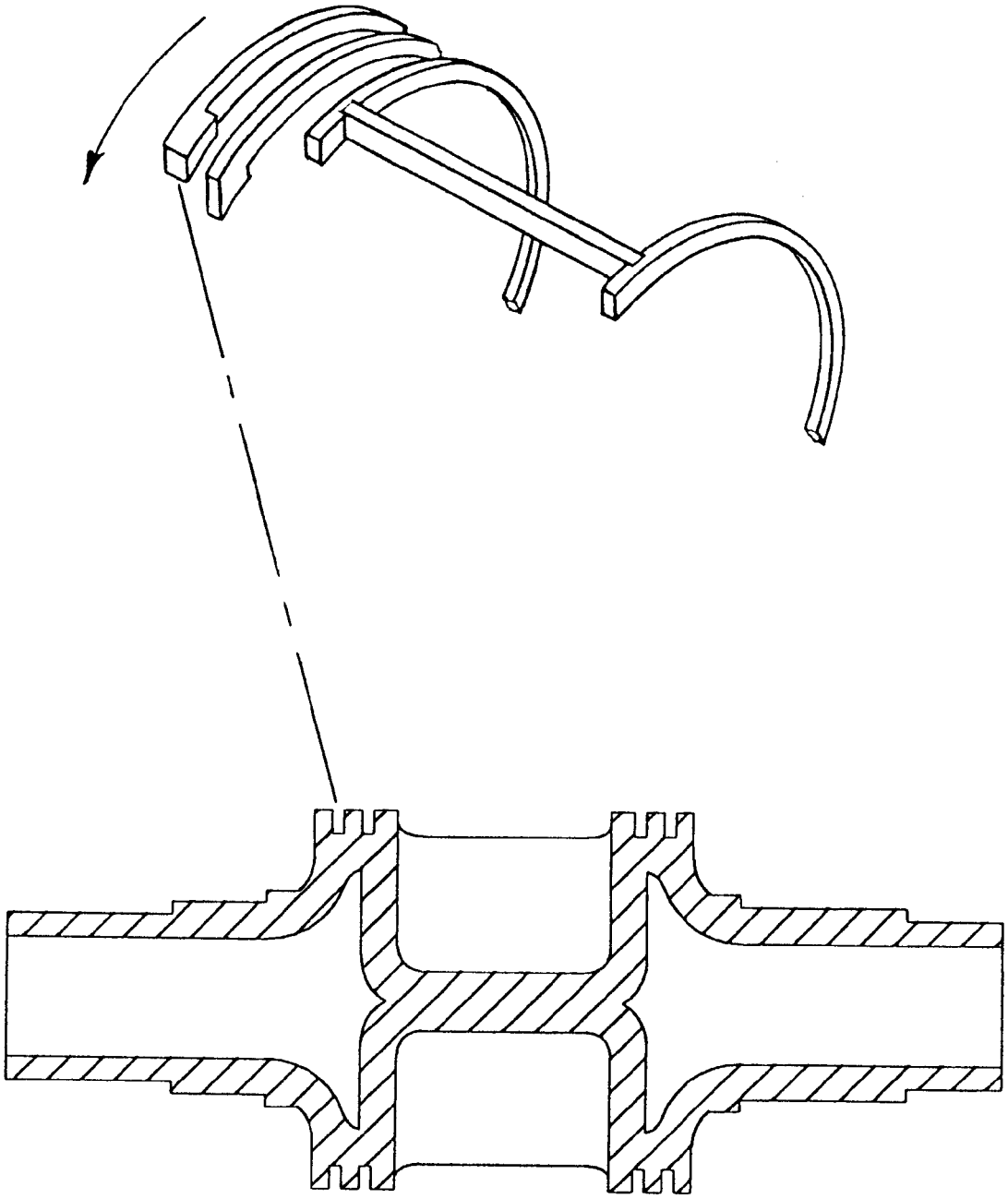
FIG. 7*c* shows a possible single unit combustion housing and ring configuration.

FIG. 7*a* illustrates a combustion housing in which the cylindrical rings are tilted to provide a different way to possibly better seal the rings.

FIG. 7*b* shows a different way to drive the cylindrical rings.

FIG. 7*c* shows various views and cut aways of a single unit SPE combustion housing. Three possible ways to drive the cylindrical rings are also shown in this figure.

Figure 8:
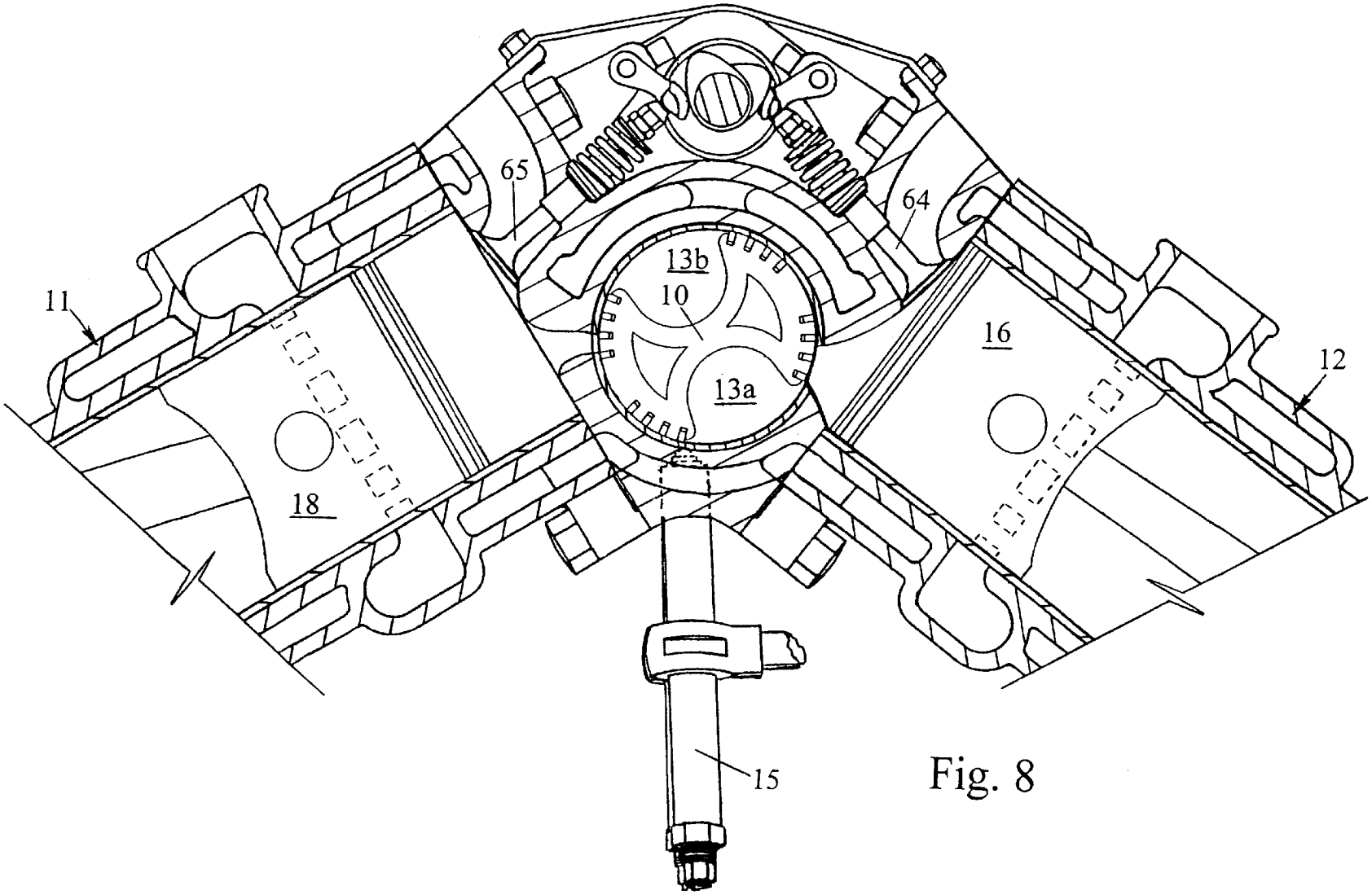
FIG. 8 shows a SPE using poppet valves for induction and exhaust

FIG. 8 shows an SPE engine where poppet valves are used for induction and exhausting. The poppet intake valves 64 are located in the head directly over the piston compressor's chamber and they can open shortly after re-expansion of the compressors clearance volume or after the piston has dropped slightly as to not touch the opening poppet valve. The poppet intake valve closes shortly after bottom dead center so compression can begin. The poppet cam is directly chained or belted to the compression crank and revolves at the same RPM as the crank, similar to a two cycle diesel engine. The poppet exhaust valves 65 are located in the head directly over the piston expansion chamber. The exhaust valve opens near 120 degrees after top dead center or near bottom dead center and does not need to begin closing until around 80 degrees before top dead center or before the expansion piston is near enough to hit the poppet valve. A closer Otto cycle can be achieved by using extreme late closure. The valve should close early enough in order to trap enough gas so the pressure in the expansion chamber reaches a high pressure. The cam for the exhaust poppets also runs at the same RPMs as the crank shafts. The intake and exhaust poppets could share the same cam. These poppet valves can be used exclusively for induction and exhausting or can be used in combination with lower intake and exhaust ports. The SPE engine could use only intake poppet valves in the piston compressor and use only standard two stroke porting in the expansion cylinder. The SPE engine could also use poppet exhaust valves only in the piston expander and use only lower intake porting in the compression cylinder.

Figure 9:
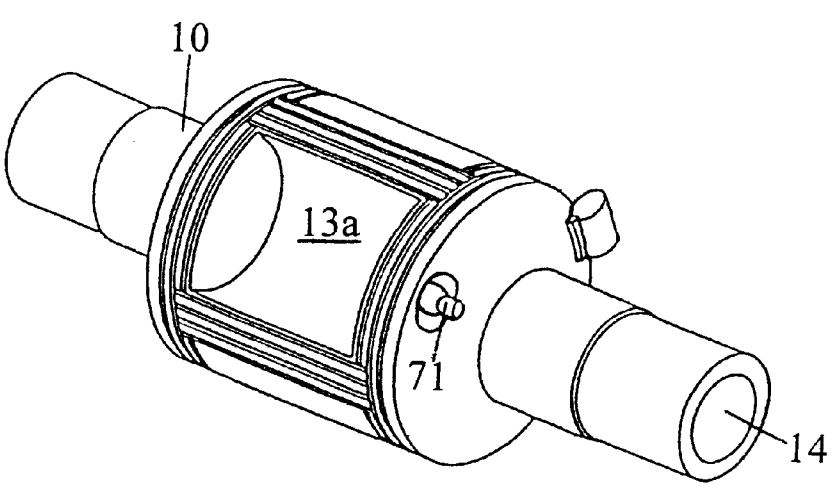
FIG. 9 shows a spark ignition combustion housing with an ignition device in each combustion chamber which passes by an electrical pick up.

FIG. 9 illustrates using igniters 71 in the combustion chambers of the combustion housing. The igniter can be fired when it rotates next to a pick up 72 or metal plate similar to the end of a rotor in a distributor. A coil can fire and send the electrical impulse up to the pick up plate which will jump the small gap to the igniter and discharge through the combustion housing which is grounded. Both igniters in each combustion chamber can be energized through the same pick up. Gasoline can be inducted into the piston compressor and can be loaded into the combustion chambers during piston compressor compression or it can be injected into the combustion chamber as in previous configurations. Thus the SPE cycle can be run in a spark ignition version.

Figure 10A:
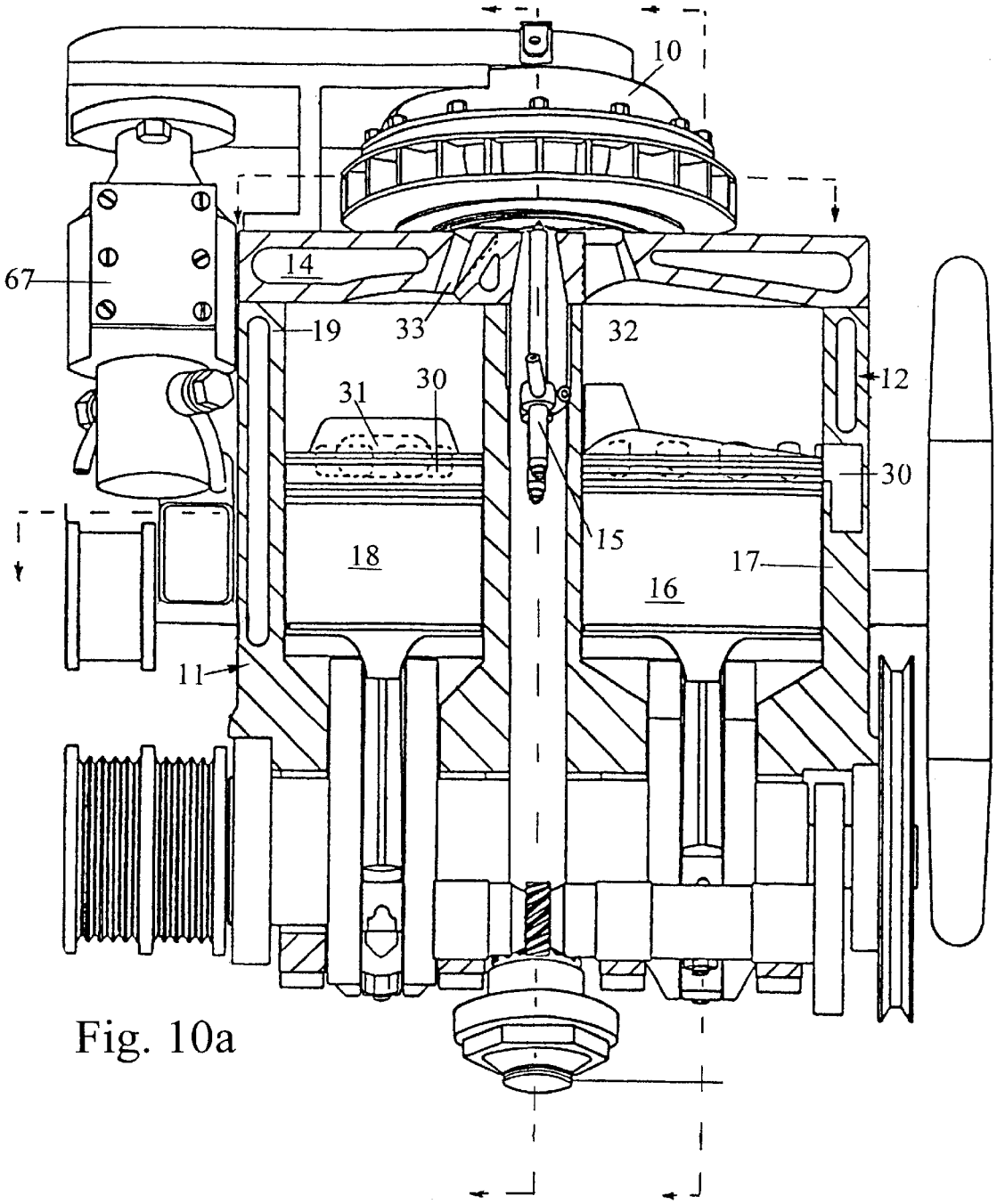
FIG. 10*a* shows a sectional view of an inline SPE which uses an air cooled combustion housing.

FIG. 10*a* illustrates a SPE configuration which is a two cylinder totally in line version where the air cooled combustion housing is connected to a single drive shaft. The combustion housing is rotated via the combustion housing shaft which is geared to the auxiliary shaft. The rotation causes the combustion housing fins to move external air near the combustion chambers, operating as a centrifugal pump. The auxiliary shaft is chained directly to the single crank shaft through reduction sprockets which rotate the combustion housing once for every two revolutions of the crank shaft. This configuration carries out the same SPE cycle as earilier described.

Figure 10B:
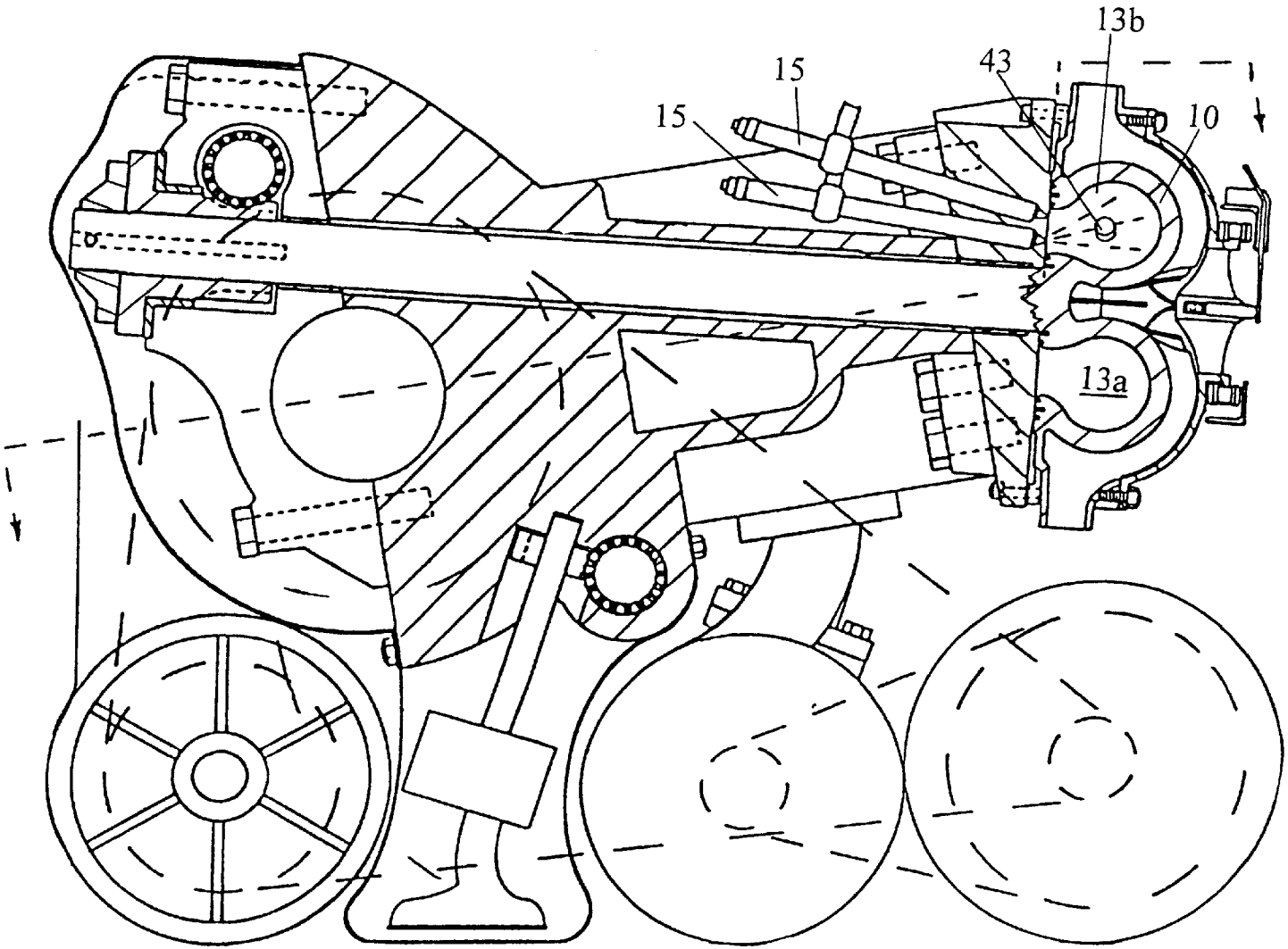
FIG. 10*b* shows a sectional side view of an inline SPE which uses an air cooled combustion housing.

FIG. 10*b* illustrates a side view section of FIG. 10*a*. Various belting of components are shown in hidden lines.

Figure 10C:
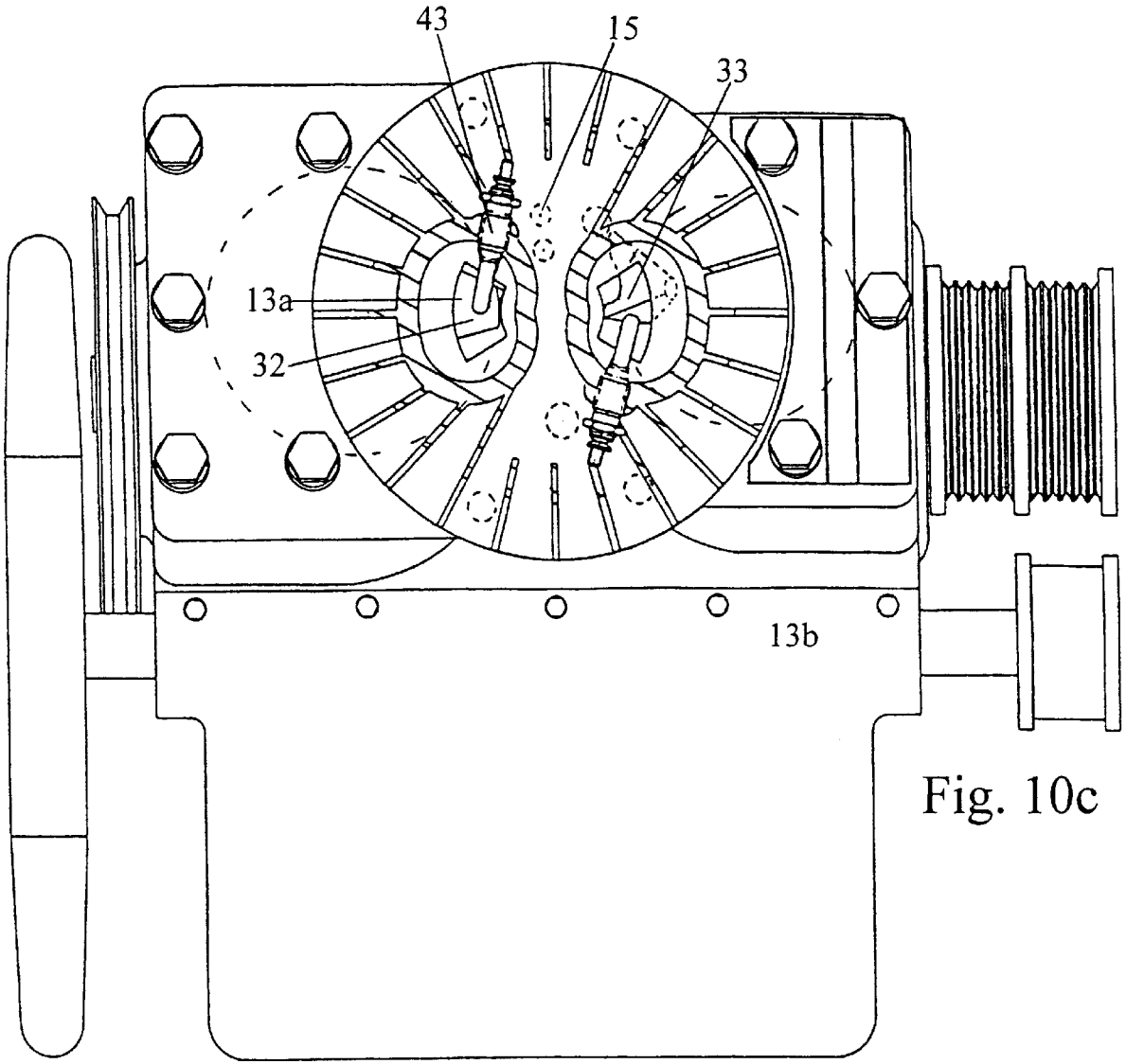
FIG. 10*c* shows a sectional top view of an inline SPE which uses an air cooled combustion housing.

FIG. 10*c* illustrates a sectional view of FIG. 10*a*. In this view, the combustion housing is cut away revealing the shapes of the combustion chambers. Mounting of glow plugs are also illustrated.

Figure 10F:
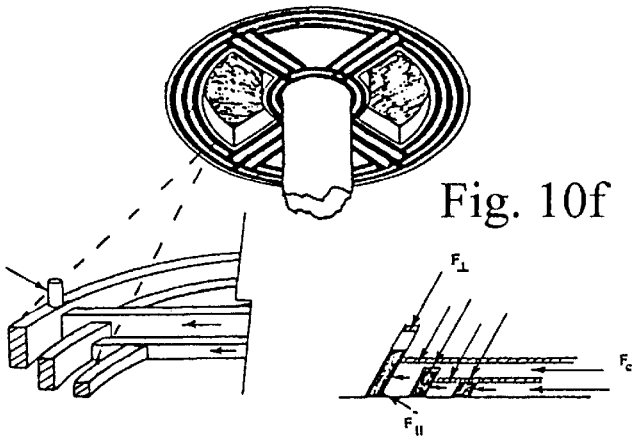
FIG. 10*f* shows a possible ring seal configuration.
Figure 10G:
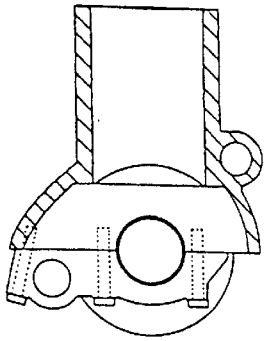
FIG. 10*g* shows a sectional view of the block of an inline SPE which uses an air cooled combustion housing.
Figure 10E:
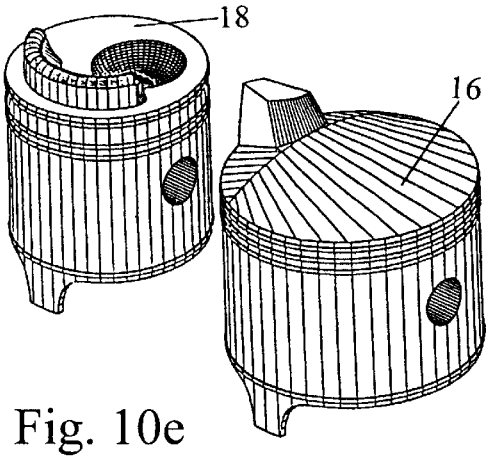
FIG. 10*e* shows a possible compressor and expansion piston.
Figure 10D:
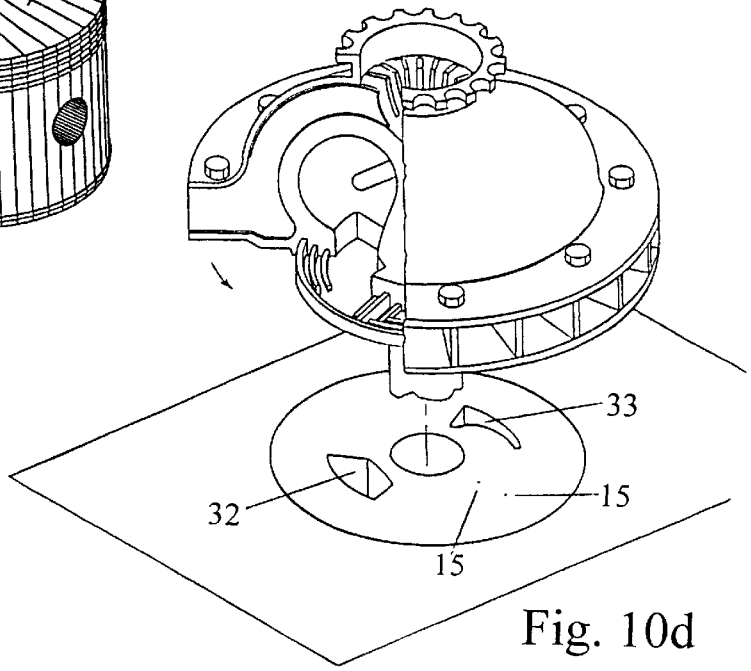
FIG. 10*d* shows a partial view of an inline SPE which uses an air cooled combustion housing.
Figure 11:
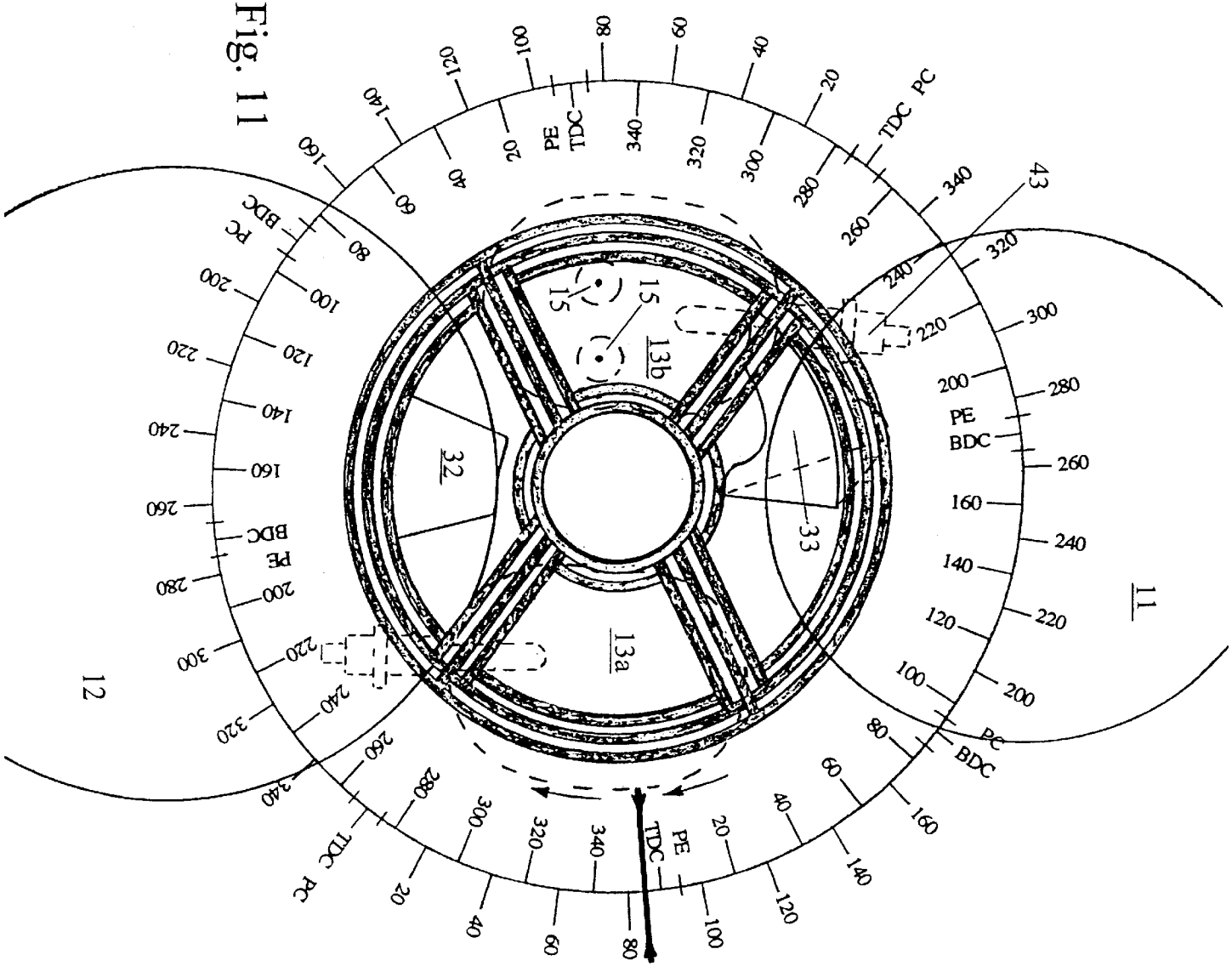

FIG. 10*d* illustrates a cut away of the combustion housing and possible port shapes leading to the two piston processors.

FIG. 10*e* shows two possible shapes of the compressor piston and expander piston.

FIG. 10*f* shows one possible ring configuration with varying ring heights which isolate various ring crevice volumes. The ring grooves of the combustion housing are illustrated in an isometric view of the bottom of the combustion housing.

Figure 11:
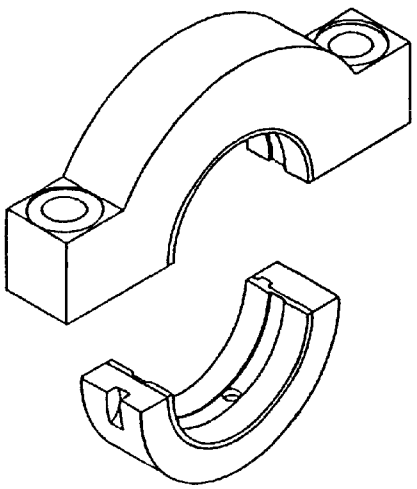
FIG. 11 shows a pin wheel diagram of the inline SPE engine.
Figure 11K:
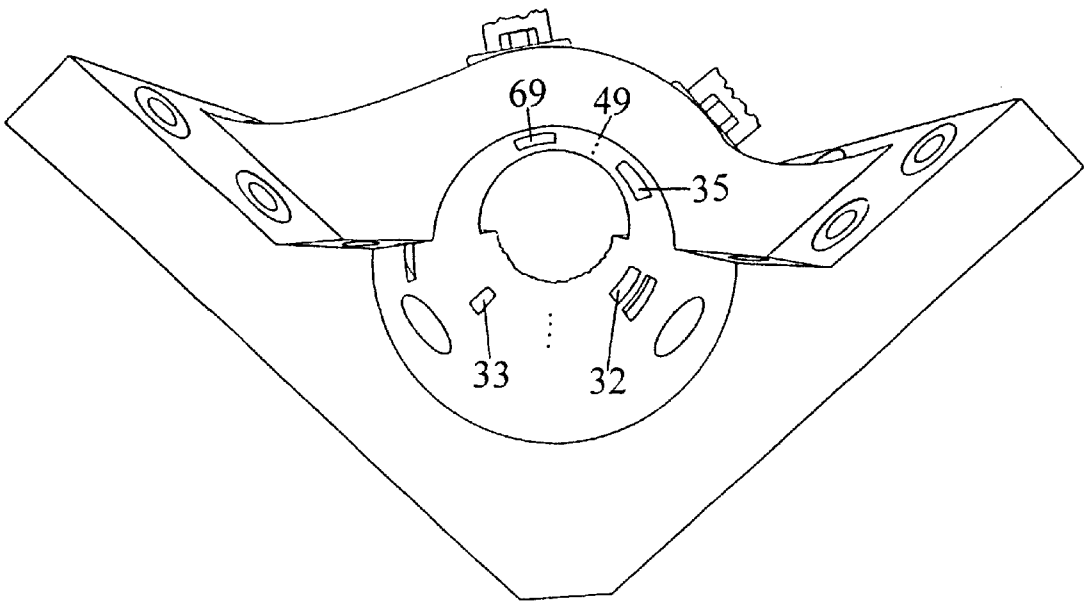

FIG. 11 is a pinwheel schematic of the combustion housing timing events as in relation to the two piston processors. This operates in the same manner as FIG. 1*e* and 2*c*. Again, the compressor piston's relative position is illustrated by the outer timing marks while the inner timing marks refer to the expander piston positions. All timing marks refer to after top dead center positions. Note that the two piston processors are out of phase by 90 degrees.

SUMMARY, RAMIFICATIONS, AND SCOPE

This external combustion engine provides a revolutionary way to carry out combustion that has not been carried out to date. This invention will prove that the constant volume time for combustion can be controlled by transfer time between a compression processor and an expansion processor practically and efficiently. This will provide the ability to burn fuels which are slow in induction and combustion time with high engine outputs and efficiencies that has never been achieved to date. This revolutionary engine will provide the ability to operate on many different fuels with high revolutions per minute of the engine which will produce higher horsepowers and efficiencies than have been achievable to date. This engine will provide much more favorable emissions as the processing chambers can be optimized when manufactured and during operation to lower emissions.

I have invented an external combustion engine that burns a mixture of fuel and air to produce work, the engine comprising: (a) at least one power cylinder, each power cylinder having a moving power piston that creates a variable internal volume, each power cylinder adapted to receive an ignited mixture of fuel and air, the expansion of which moves the power piston and produces work, each power cylinder further adapted to discharge the burned fuel and air; (b) a compression cylinder for each said power cylinder, each compression cylinder having a moving compression piston that creates a variable internal volume, each compression cylinder adapted to receive air and to compress the air by the movement of the compression piston, each compression cylinder further adapted to discharge the compressed air; (c) a moving combustion housing; (d) at least one fuel injector for injecting fuel into said moving combustion housing; (e) a plurality of combustion chambers within said moving combustion housing for each said power cylinder, each combustion chamber adapted to cyclically: (i) establish communication with a compression cylinder to receive compressed air; (ii) terminate communication with the compression cylinder; (iii) receive sufficient fuel from the fuel injector to create a combustible mixture of fuel and air; (iv) contain the ignition of the combustible mixture of fuel and air; (v) establish communication with a power cylinder to discharge the ignited mixture of fuel and air into the power cylinder; and (vi) terminate communication with the power cylinder.

This external combustion engine is going to revolutionize the way combustion has been carried out to date. This is the first time that the constant volume time for combustion can be controlled by transfer time between a compression processor and an expansion processor practically and efficiently. This will allow the ability to burn fuels which are slow in induction and combustion time with high engine outputs and efficiencies as has never been achieved to date. This revolutionary engine will allow operation on many fuels with high revolutions per minute of the engine which will produce higher horsepower's and efficiencies than have been achievable to date. The emissions will be much more favorable as the processing chambers can be optimized when manufactured and during operation to lower emissions.

Although the description above contains many specificities, these should not be construed as limiting the scope of the invention but to merely provide illustrations of some of the presently preferred embodiments of this invention. For example, the compression and expansion processors pistons need not reciprocate, as they could travel in an orbit in a toroidal cylinder to process the fluid; the processors could be air cooled or made of ceramic material with no fluid or air coolants; fewer or more sealing rings could be used on the combustion housing; different types of bearings could be used on the combustion housing; various ignition devices could be used to ignite the charge in the combustion chamber, etc.

Thus the scope of the invention should be determined by the appended claims and their legal equivalents, rather than by the examples given.

I claim:

1. An external combustion engine that burns a mixture of fuel and air to produce work, the engine comprising:

(a) at least one power cylinder, each power cylinder having a moving power piston that creates a variable internal volume, each power cylinder adapted to receive an ignited mixture of fuel and air, the expansion of which moves the power piston and produces work, each power cylinder further adapted to discharge the burned fuel and air;

(b) a compression cylinder for each said power cylinder, each compression cylinder having a moving compression piston that creates a variable internal volume, each compression cylinder adapted to receive air and to compress the air by the movement of the compression piston, each compression cylinder further adapted to discharge the compressed air;

(c) a moving combustion housing;

(d) at least one fuel injector for injecting fuel into said moving combustion housing; and (e) at least one combustion chamber within said moving combustion housing for each said power cylinder, each combustion chamber adapted to cyclically:

(i) establish communication with a compression cylinder to receive compressed air;

(ii) terminate communication with the compression cylinder;

(iii) receive sufficient fuel from the fuel injector to create a combustible mixture of fuel and air;

(iv) contain the ignition of the combustible mixture of fuel and air;

(v) establish communication with a power cylinder to discharge the ignited mixture of fuel and air into the power cylinder; and (vi) terminate communication with the power cylinder.

2. The external combustion engine of claim 1 additionally comprising a plurality of combustion chambers in said moving combustion housing for each said power cylinder.

3. The external combustion engine of claim 2 wherein the said combustion housing rotates.

4. The external combustion engine of claim 3 additionally comprising a single crank that operates each said power piston and each said compression piston.

5. The external combustion engine of claim 4 wherein the said crank and the said combustion housing rotate in a parallel orientation.

6. The external combustion engine of claim 5 additionally comprising a V configuration of the said power cylinder and said compression cylinder.

7. The external combustion engine of claim 3 additionally comprising a first crank that operates each said power piston and a second crank that operates each said compression piston.

8. The external combustion engine of claim 7 wherein the power piston crank has a rotational relationship to the compression piston crank and additionally comprising a means for advancing or retarding the rotational relationship of the power piston crank relative to the compression piston crank.

9. The external combustion engine of claim 7 wherein the said first crank said second crank and said combustion housing rotate in a parallel orientation.

10. The external combustion engine of claim 4 wherein the said combustion housing has a rotational relationship to the said crank and additionally comprising a means for advancing or retarding the rotational relationship of the combustion housing relative to the said compression piston crank.

11. The external combustion engine of claim 7 wherein the said compression cylinder top and said power cylinder top face towards each other in some orientation.

12. The external combustion engine of claim 1 additionally comprising a plurality of fuel injectors for each said power cylinder.

13. The external combustion engine of claim 2 additionally comprising a plurality of fuel injectors for each said power cylinder.

14. The external combustion engine of claim 2 additionally comprising combustion chamber scavenging intake and exhaust ports.

15. The external combustion engine of claim 2 additionally comprising a power cylinder scavenging means.

16. The external combustion engine of claim 2 additionally comprising a glow plug in each combustion chamber.

17. The external combustion engine of claim 2 additionally comprising valves for discharging the burned fuel and air from each power cylinder, and valves for receiving air into each compression cylinder.

18. An external combustion engine that burns a mixture of fuel and air to produce work, the engine comprising:

(a) at least one power cylinder, each power cylinder having a moving power piston that creates a variable internal volume, each power cylinder adapted to receive an ignited mixture of fuel and air, the expansion of which moves the power piston and produces work, each power cylinder further adapted to discharge the burned fuel and air;

(b) a compression cylinder for each power cylinder, each compression cylinder having a moving compression piston that creates a variable internal volume, each compression cylinder adapted to receive a combustible mixture of fuel and air and to compress the mixture of fuel and air by the movement of the compression piston, each compression cylinder further adapted to discharge the compressed mixture of fuel and air;

(c) a compression crank which operates the said compression piston;

(d) a ignition means for igniting the combustible mixture of fuel and air; and (e) a rotating combustion housing with at least one combustion chamber for each power cylinder, each combustion chamber adapted to cyclically:

(i) establish communication with a compression cylinder to receive the compressed mixture of fuel and air;

(ii) terminate communication with the compression cylinder;

(iii) receive ignition from the ignition means to ignite the compressed mixture of fuel and air;

(iv) contain the ignition of the combustible mixture of fuel and compressed air;

(v) establish communication with a power cylinder to discharge the ignited mixture of fuel and air into the power cylinder; and (vi) terminate communication with the power cylinder; wherein said compressor crank and said combustion housing rotate in a parallel orientation.

19. The external combustion engine of claim 18 additionally comprising a plurality of combustion chambers in said rotating combustion housing for each said power cylinder.

20. The external combustion engine of claim 19 additionally comprising a V configuration of the said power cylinder and said compression cylinder.

21. The external combustion engine of claim 19 additionally comprising a power cylinder scavenging means.

22. The external combustion engine of claim 19 wherein the combustion housing has a rotational relationship to the said compression crank and additionally comprising a means for advancing or retarding the rotational relationship of the combustion housing relative to the said compression crank.

23. The external combustion engine of claim 18 additionally comprising a second crank that operates the said power piston and said second crank rotates in a parallel orientation with said compressor crank and said combustion housing.

24. The external combustion engine of claim 19 additionally comprising a second crank that operates the said power piston and said second crank rotates in a parallel orientation with said compressor crank and said combustion housing.

25. The external combustion engine of claim 24 wherein the power piston crank has a rotational relationship to the compression piston crank and additionally comprising a means for advancing or retarding the rotational relationship of the power piston crank relative to the compression piston crank.

26. The external combustion engine of claim 24 wherein the said compression cylinder top and said power cylinder top face towards each other in some orientation.

27. An external combustion engine that burns a mixture of fuel and air to produce work, the engine comprising:

(a) at least one power chamber, each power chamber having a moving wall that creates a variable internal volume, each power chamber adapted to receive an ignited mixture of fuel and air, the expansion of which moves the wall and produces work, each power chamber further adapted to discharge the burned fuel and air;

(b) a compression chamber for each said power chamber, each compression chamber having a moving wall that creates a variable internal volume, each compression chamber adapted to receive air and to compress the air by the movement of the wall, each compression chamber further adapted to discharge the compressed air;

(c) a moving combustion housing;

(d) at least one fuel injector for injecting fuel into said moving combustion housing; and (e) at least one combustion chamber within said moving combustion housing for each said power cylinder, each combustion chamber adapted to cyclically:

(i) establish communication with a compression chamber to receive compressed air;

(ii) terminate communication with the compression chamber;

(iii) receive sufficient fuel from the fuel injector to create a combustible mixture of fuel and air;

(iv) contain the ignition of the combustible mixture of fuel and air;

(v) establish communication with a power chamber to discharge the ignited mixture of fuel and air into the power cylinder; and (vi) terminate communication with the power chamber.

28. The external combustion engine of claim 27 additionally comprising a plurality of combustion chambers in said moving combustion housing for each said power cylinder.

* * * * *